US005402988A

United States Patent [19]

Eisele

[11] Patent Number: 5,402,988

[45] Date of Patent: Apr. 4, 1995

[54] PORTABLE FENCE

[75] Inventor: Stanley R. Eisele, Santa Barbara, Calif.

[73] Assignee: Specialty Recreation Equipment, Inc., Goleta, Calif.

[21] Appl. No.: 964,444

[22] Filed: Oct. 21, 1992

Related U.S. Application Data

[63] Continuation-in-part of Ser. No. 431,642, Nov. 3, 1989, abandoned.

[51] Int. Cl.[6] ..... E04H 17/18

[52] U.S. Cl. ..... 256/24; 256/19; 256/26; 256/73; 256/DIG. 2; 160/351; 40/610

[58] Field of Search ..... 256/24–26, 256/65, 1, 13.1, 19, 32, 23, 12.5, DIG. 2, 27–31, 33, 45–47; 404/10, 6; 160/351, 135, 377; 40/606, 610

[56] References Cited

U.S. PATENT DOCUMENTS

| | | | |
|---|---|---|---|
| 807,592 | 12/1905 | Becker | 256/31 |
| 935,522 | 9/1909 | King | 256/DIG. 2 X |
| 3,021,114 | 2/1962 | O'Connell | 256/47 X |
| 3,305,221 | 2/1967 | Kling | 256/24 X |
| 3,499,631 | 3/1970 | Heldenbrand | 256/25 |
| 3,662,482 | 5/1972 | Sarkisian | 40/606 X |
| 3,933,311 | 1/1976 | Lemelson | 256/24 X |
| 4,124,198 | 11/1978 | Wong | 256/24 |
| 4,339,114 | 7/1982 | Deike | 256/12.5 |
| 4,356,999 | 11/1982 | McShane | 256/26 |
| 4,413,361 | 11/1983 | Wolf et al. | 4/506 |
| 4,465,262 | 8/1984 | Itri et al. | 256/24 |
| 4,535,974 | 8/1985 | Conde | 256/1 |
| 4,605,204 | 8/1986 | Schmanski et al. | 256/19 |
| 4,646,807 | 3/1987 | Doublet | 256/24 X |
| 4,727,702 | 5/1988 | Baker et al. | 52/656 |
| 4,765,596 | 8/1988 | Fontana | 256/65 |
| 4,792,258 | 12/1988 | Goff | 404/10 X |
| 4,806,046 | 2/1989 | Clark | 404/10 |
| 4,830,142 | 5/1989 | McManus | 182/92 |
| 4,844,424 | 7/1989 | Knudslien | 256/26 |

FOREIGN PATENT DOCUMENTS

| | | | |
|---|---|---|---|
| 2286241 | 4/1976 | France | 256/19 |
| 2441046 | 7/1980 | France | 256/27 |
| 10092 | of 1906 | United Kingdom | 256/24 |
| 2063956 | 6/1981 | United Kingdom | 256/24 |
| 2067629 | 7/1981 | United Kingdom | 256/13.1 |

OTHER PUBLICATIONS

Flexible Safety Fencing by Carsonite, Jun. 1988.
Reduce Risk of Injury by Windscreens West, Inc.
Tough, Versatile Safety Fences by Tenax Corporation.
Softball Equipment by Innovative Products Incorporated, 1990.

*Primary Examiner*—Randolph A. Reese
*Assistant Examiner*—Harry C. Kim
*Attorney, Agent, or Firm*—Hawes & Fischer

[57] ABSTRACT

The present portable fence is durable, lightweight and easily transported, erected and dismantled. In use, it will collapse upon impact, due to a break away, in the first embodiment, a joint between the fence post and its supporting leg, and in the second embodiment a joint in the supporting leg, yet in both embodiments the fence may be quickly and easily re-erected.

17 Claims, 15 Drawing Sheets

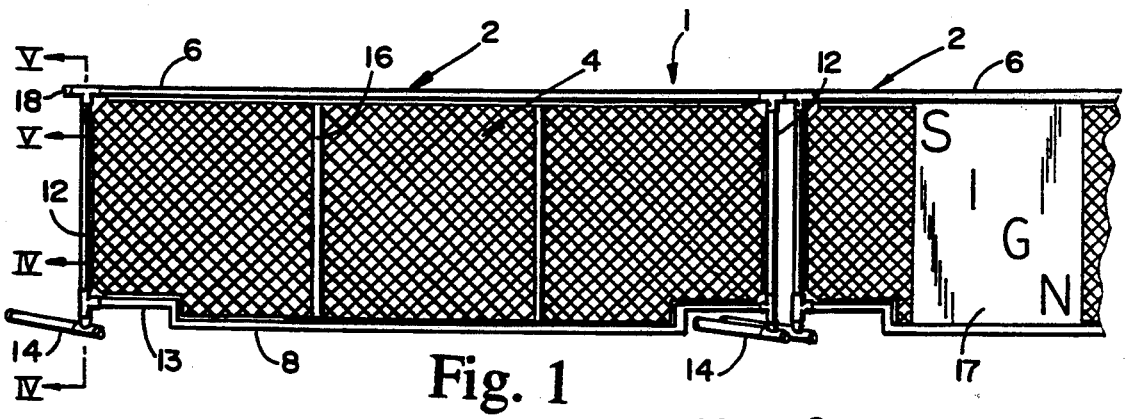
Fig. 1
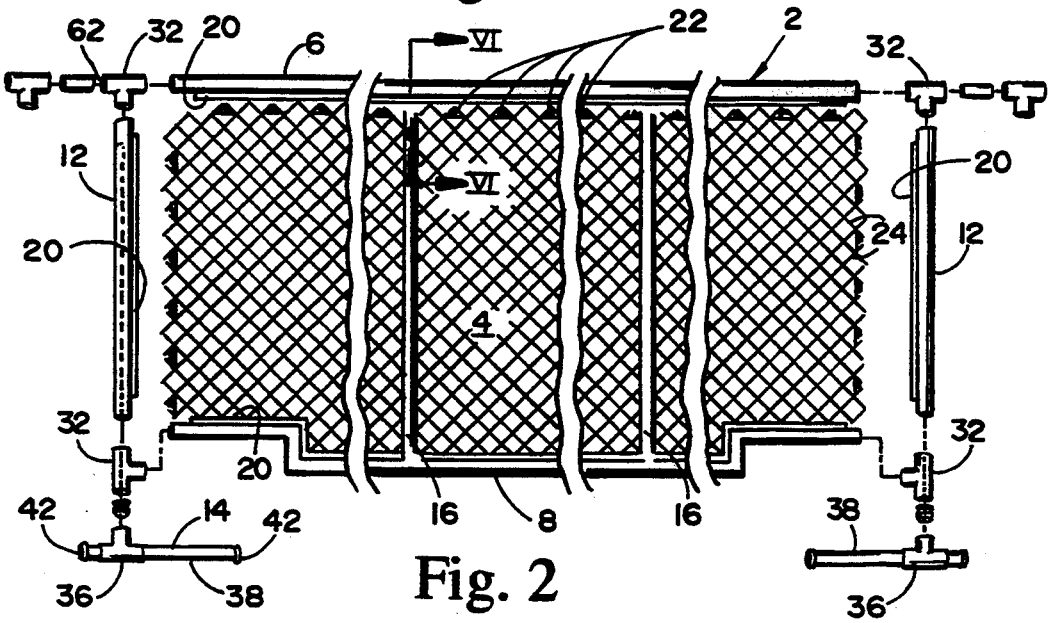
Fig. 2
Fig. 3
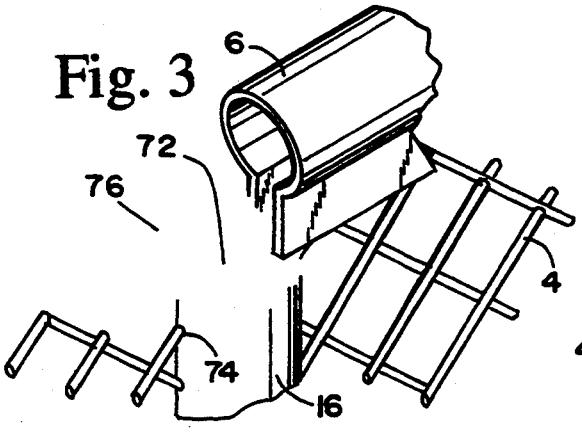
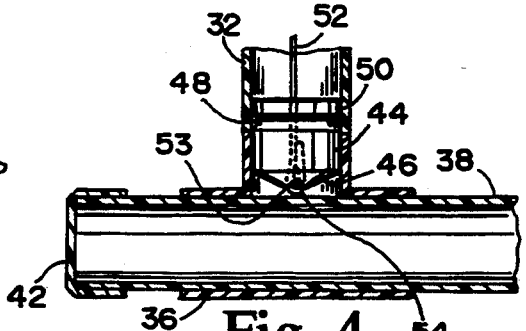
Fig. 4

PORTABLE FENCE

This case is a continuation-in-part of U.S. patent application Ser. No. 07/431,642, filed on Nov. 3, 1989, now abandoned.

BACKGROUND OF THE INVENTION

The present invention relates to embodiments of a new portable fence construction, particularly one useful in sporting events, crowd control and in situations when a fence is needed for a purpose that does not require, or permit permanent fencing.

Fences enhance the playing of various games in many ways, and also promote safety to participants and spectators. For example, the presence of a fence produces a boundary for a baseball or softball playing field. Properly distanced from home plate, a fence will allow well hit balls to be counted as home runs. The sight of a long fly ball sailing over the outfield fence for a home run adds tremendous thrill and excitement to such games, both for players and spectators. Likewise, on sharply hit balls which do not have the distance to carry over the fence, a fence will prevent them from rolling out and becoming "cheap" home runs. For example, when playing softball or baseball an outfield fence will keep sharply hit ground balls in the playing field and will prevent a ball sharply hit through the gap between outfielders from turning into a "cheap" home run. A fence also defines the playing field boundaries, and prevents a well hit fly ball that should be a home run from being caught by an outfielder. The sight of a long fly ball sailing over the outfield fence for a home run adds tremendous thrill and excitement to such games, both for players and for spectators.

The presence of a fence in other sporting uses can provide a significant reduction of serious injury to the participants and spectators. For example, a fence placed around discus and shot put landing areas at a track and field competition reduces the risk of serious injury, even death, to anyone who might inadvertently wander into those areas.

Fences are commonly employed in situations requiring crowd control. The presence of a fence to keep people confined to, or away from, a specific area is frequently required by coaches, athletic administrators, park directors, nursery school operators, and many others.

For most of these applications, and more, the use of a fence permanently attached to the ground is not appropriate. Existing portable fence products on the market, include those such as: (1) "portable" metal chain link fence panels, which are very heavy, dangerous and require a great deal of time to set-up and take down, or (2) a type of fence which requires that stakes or posts be driven into the ground and then a mesh fabric hung to them, and cannot be used on hard surfaces, and can be dangerous.

Most athletic and recreation administrators will choose not to use such types of fencing because of the great deal of time they take to set up and take down, as well as the unsightly appearance of the metal fences. If the fence is not dismantled after each event or activity, they cannot utilize that field for most other activities. Also, the stakes or posts, when inserted into the ground can cause damage to underground sprinkler pipes and, when removed, leave holes in the playing field on which players can trip and injure themselves.

In many cases, there is a need for portable fencing on a hard surface such as a sidewalk or street, or a gymnasium or field house floor. The only fence hereto available has been the "portable" metal chain link panels, saw horses, ropes and flags, roll fencing, snow fencing and the like. Further, the above mentioned fences which are used for marking a playing field and which may only be as sturdy as necessary for this task, make a poor crowd control fence. Likewise, a good crowd control fence might prove hazardous for a playing field where it was so sturdy that a player collision with the fence could cause player injury. This is especially the case where the fence is heavy, where the player might become caught along the top edge, and be forced to ride the top of the fence to the ground. Crowd control fences are not designed to yield, and are typically made of metal, which can further cause injury.

Both crowd control fences and sports fences also often suffer from not being closely associated to adjacent sections. In crowd control, it is advantageous to connect adjacent fence sections so that each panel may gain the strength from its immediate and next several most adjacent panels. In crowd control, only a small relative movement between two fence sections is sufficient to allow significant numbers of the crowd to pour through to the protected area.

In sports applications, when a player collides with one or two separated sections, a grounds keeper attendant is usually required to re-align the fence sections. If the player takes time to re-align the sections, the game lengthens and play cannot resume until the player finishes his task. When a player collides with a fixed fence section, or fence section which is rigidly interconnected with other fence sections, the result is generally injury to the player.

An additional use for a fence, one well recognized by professional stadiums, is the availability of advertising space. Businesses or corporations wishing to attract the attention of, and send a message to, players and fans of the game or activity can easily attach their messages to the outfield fence. Owners of the fence can derive significant revenue from such advertising space, too. The ability to affix permanently an advertising logo can also be used to attract sponsorship which will permanently defray or reduce the cost of the fence for the sports director in exchange for a fence system which will permanently display their logo or message, even months and years into the future.

Therefore in many sports, for example, there is a need for a fence which is safe for the players, portable, durable, easily erected and taken down, compact, affordable and attractive. The needed fence should perhaps have the ability to interconnect fence sections, assume a first configuration more conducive to sports play and a second configuration more conducive to crowd control. The dimensions should be such that the clearance below and between adjacent fence sections is sufficient to prevent passage of a baseball.

The needed fence should have a loose connection between adjacent sections sufficient to resist wind forces, yet be able to release from adjacent fence sections, "break away" from a vertical orientation, and fall flat in order to minimize injuries. The needed fence should be able to break away, and fall flat even when connected to adjacent fence sections, to provide for re-erecting the fence in a stable configuration, without the need for measurement in the fence's re-alignment.

SUMMARY OF THE INVENTION

The first embodiment of the portable fence of the present invention consists of a frame holding a fencing net, the frame having at least a bottom side. A base element engages the bottom side of the fence and supports the fence frame in a vertical position relative to a field or other surface. A collapsible mechanism attaches the base element to the frame, and permits the base to disengage from the frame on application of a predetermined force to the frame, such as when a player collides with the fence, thereby permitting the fence to collapse flat on the field.

The fence section of the present permits the rapid and easy configuration and re-configuration of a playing surface. There currently may be upwards of 200,000 unfenced playing fields in the United States which can benefit from the use of a portable fence. Existing fields can benefit from re-configuration using the fence 101 of the present invention by enabling, and by its ease of use encouraging the multiple uses of existing fields. A regulation sized baseball field can be configured for softball, little league, or T ball, each by configuring the portable fence sections of the present invention into the proper configuration. A four hundred foot section of the fence of the present invention can be constructed in about thirty minutes by just two people. The fence section of the present invention contains no sharp edges and weighs about 25 pounds per fence section, and may vary only slightly depending upon the size of the section. Further the fence sections of the present invention save money by having both a sports use and a crowd control use, particularly important where budgets are tight, and organizations do not have the luxury of investing in two fixed use fence systems.

Preferably the mechanism attaching the base to the frame holds the frame and base together when the fence is being collapsed, and upon the fence being repositioned in a generally vertical orientation, urge the base back into engagement with the frame such that it will again hold the frame upright relative to the playing field.

In addition, preferably the frame may be releasably connected to adjacent frames to form an elongated fence, this releasable engagement including, in the first embodiment, compressible plugs received in opposed sockets in adjacent fence sections, the plugs being compressed and frictionally holding the fence sections together, but permitting the fence sections to release from one another on application of the predetermined force to a section of the fence.

Further, in the first embodiment, the preferred construction the portable fence frame is formed of marginal elements consisting of hollow tubes bearing inwardly facing flanges, the fence netting being received in the flange, these structures preferably consisting of elements which interlock the fence netting margin with the flange.

The portable fence of the present invention provides the user with the benefits of: (1) being able to use it on all types of hard surfaces, as well as on turf or dirt, indoors or outdoors, (2) quick and easy set up and dismantling, since it is lightweight and does not require stakes or posts, (3) convenient and compact storage when not in use and convenient transport for use, and (4) reduced risk of injury to players, spectators and maintenance personnel.

The second embodiment of the present invention includes a section which breaks away in the vertical plane, to fall flat, and which can be configured in (1) a break away position, including a chamfered button lock to ensure this position, and (2) a non-break away, or crowd control position. The second embodiment also possesses affirmative structure to interlock adjacent sections of fence in a first loosely connected state for quick release on player impact for use while the fence is in breakaway position, and in a securely locked position for a strong hold while in crowd control position. Three interlock mechanisms are shown, two which provide a minimum opportunity for locking and unlocking of the fence sections without the use of an instrument to perform interlock actuation, and another which involves the simple turning of a knob to lock and unlock adjacent fence sections.

BRIEF DESCRIPTION OF THE DRAWINGS

The invention will be further described in connection with the accompanying drawings in which:

FIG. 1 is a perspective view of a portable fence constructed in accordance with the teachings of the present invention;

FIG. 2 is an exploded view of the preferred construction of fence;

FIG. 3 is a broken view, a portion of the rail and netting of the preferred fence;

FIG. 4 is a view in cross-section of a portion of the foot and side frame members of the portable fence taken on line IV—IV of FIG. 1;

DETAILED DESCRIPTION

Figure 5:
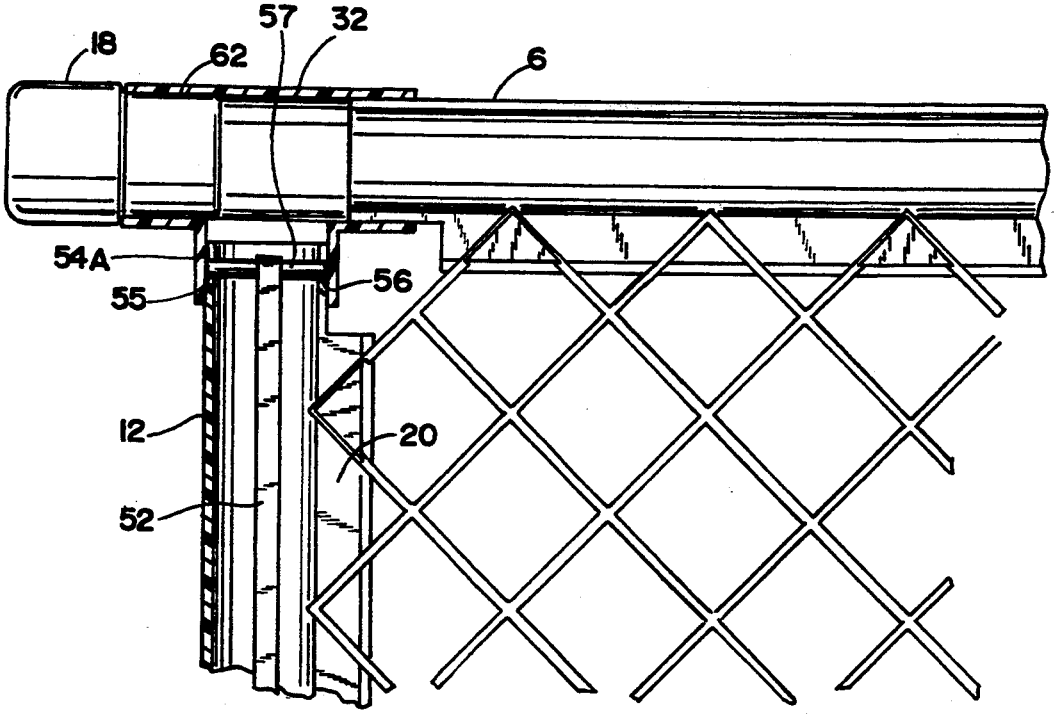
FIG. 5 is a cross-sectional view of the upper corner portion of the fence taken on lines V—V of FIG. 1, and illustrating one possible way in which an elastic member may be supported.

The first embodiment of the portable fence of the present invention is shown in FIGS. 1–7 and is intended to be assembled, with similar sections, into a fence of any desired length, such as a length sufficient to define the outfield boundary of a baseball or softball field. In this embodiment, the portable fence is designed as a sectional element. It is also designed to be easily transported to and from any location; it is lightweight and can be easily carried onto and off of a playing field. The fence includes foot elements that are connected to the frame members in such a fashion that they can be turned out, usually to a 90° approximate angular extent, to support the fence on a field, but turned back into the plane of the section of portable fence to permit the section to be conveniently carried, transported and stored.

A typical use for the preferred portable fence is to define boundaries of a-playing field during a game such as baseball or softball. It is, of course, quite important that any athletic fence be safe. Those playing a game in an area defined by a fence will understandably have their attention on the game, and may unexpectedly encounter the fence while running away from the center of the playing field but looking back onto the playing field and away from the fence. Some present fences do not protect players in such situations (1) they readily cause the player to cartwheel over the fence, (2) cause severe impact resistance to the player (3) have sharp edges, etc., which in turn may cause the player serious injury. Once a fence with permanently and rigidly affixed feet is overturned, subsequent players may fall upon them and become even more severely injured.

The first embodiment of the portable fence of the present invention addresses each and all of these significant concerns.

The preferred construction of the portable fence of the first embodiment of the present invention is shown in the drawings. Referring to FIGS. 1 and 2, a plan and exploded view illustrate the structures making up the first embodiment of the present invention, referred to as fence 1. Each section consists of a frame 2 defined by a series of tubular elements, to be discussed in detail, and which contain and hold netting 4. Preferably each section of fence is approximately 3½ feet high and 10 feet wide. (Of course, various uses of the portable fence will require or necessitate fence sections of different sizes.)

The frame 2 consists of a horizontal upper rail 6, a horizontal lower rail 8 and two vertical side rails 12. An off-set section 13 represents a break in the horizontal continuity of the bottom rail 8. The off-set sections 13 are to receive and enable 360° rotation of a pair of foot elements 14 which are rotatable in a horizontal plane, into alignment with a plane defined by the fence 1.

In another preferred construction of the first embodiment (not shown) the lower rail 8 does not include an off-set section, but instead extends from one vertical side rail 12 straight to the other vertical side rail 12, the foot elements 14 being rotatable to lie beneath the lower rail 8.

In the first embodiment construction, the vertical side rails 12, foot elements 14, and the various connectors (to be shown) are all made of a polyvinyl chloride (PVC) material, preferably #7164 White 94, manufactured by Georgia Gulf Corporation, PVC Division, Plaquemine, La. This material is specially formulated for use in the outdoors, where ultraviolet radiation is present. It possesses very good physical properties, especially impact strength.

Each of the vertical side rails 12, foot elements 14, and the various connectors (to be shown) are preferably hollow, interfit with the other members, and the fence 1 be constructed from materials which may be about 1½" to 2" in outside diameter depending on the size desired. In each assembled fence 1, the dimensions are ideally close such that the sizes within each fence 1 are uniform. Since the horizontal upper and lower rails 6 and 8 will be somewhat flexible, preferably the fence 1 may also include intermediate vertical supports 16 that extend between the upper and lower rails 6 and 8, respectively, to increase the structural integrity of the fence, to maintain the spaced relationship of the upper and lower rails 6 and 8, and to hold netting 4 relatively taut between the rails.

Also shown in FIG. 1 is a banner or sign 17 which may be affixed to the upper and lower rails 6 and 8, or to the netting 4. Also shown is an end cap 18 which may be utilized to seal portions of a fence 1 which occur at the end of a row of sections. Cap 18 may be made of metal, plastic, or a foam material.

An exploded view of the preferred construction of portable fence is presented in FIG. 2. FIGS. 3 through 7 show in cross-section or broken section certain portions of the fence.

Upper and lower rails 6, 8 and vertical side rails 12 are all preferably formed as extruded tubing having an outer diameter of approximately 1⅜", and include flange elements 20 (see FIG. 6 for a closeup) projecting outward relative to the center of the tubing. The vertical intermediate supports 16 lie over one side of the netting 4 and thus typically will not include flange elements 20.

The fence netting material 4 preferably is a plastic chain link style of fencing manufactured by DuPont Canada. In general, this fencing material consists of plastic strands which cross and are welded to one another and which define a mesh having squares that are approximately 1¾" along each side dimension. The material of choice is a high density polyethylene and is stabilized (or protected) against ultraviolet radiation.

Figure 6:
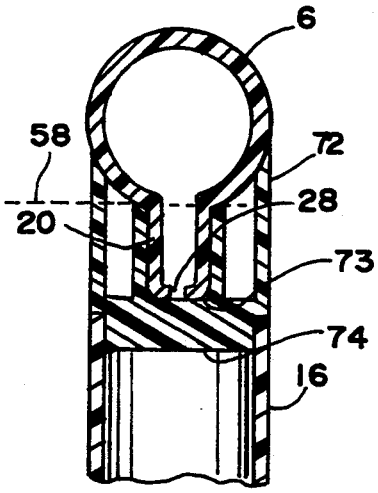
FIG. 6 is a view taken on lines VI—VI of FIG. 2 showing the preferred intermediate support member and its engagement with the upper rail element of the fence.
Figure 7:
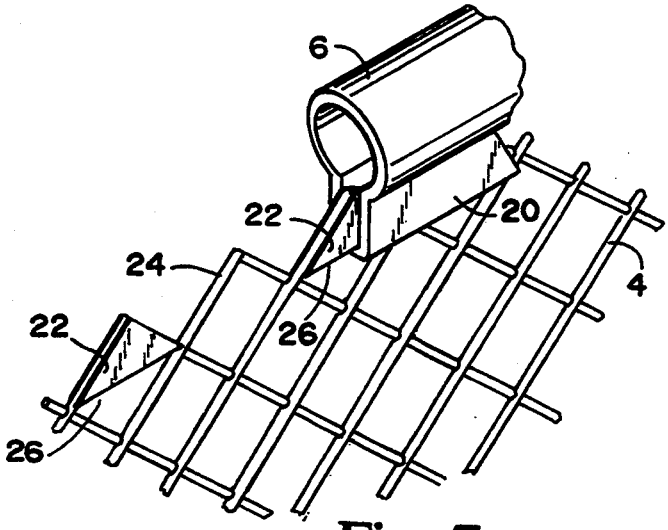
FIG. 7 is a view of a portion of the upper rail of the fence with a portion broken away to illustrate the interconnection of the rail with the margin of the fencing.

The periphery of this netting 4 is received between flanges 20, and preferably is held within flanges 20 by wedge elements 22 (see FIG. 7 for detail). These wedge elements 22 (which may be made in various sizes to fill more or less of the open squares defined by the netting 4) each have a groove to receive the strands 24 of netting 4, the strands 24 thereby nesting or interfitting with the wedge elements 22. Referring to FIG. 7 for clarity, each wedge element 22 includes a flat bottomed base portion 26 that is received between the opposed flanges 20 and which bears upon inner ledges 28 of the flange (shown in closeup in FIG. 6), the wedge elements 22 thereby interlocking with the flanges 20 to hold the netting 4 to its associated rail. The upper surface of the wedge elements 22 may be of any shape which can trap and support a strand of the netting 4.

Of course, various other connections could be employed to attach the netting 4 to any of the rails 6, 8, or 12. For example, the netting 4 could be tied to the rails, or the netting 4 could be riveted to separate flange elements (not shown) which are in turn riveted to a rail. Also such connectors may be employed in addition to the wedge elements 22, if desired.

Referring back to FIG. 3, the various rails are connected to one another by t-shaped connectors 32. To achieve such connections, flange 20 is either removed from, or does not extend to the end portions of the rails, and the remaining cylindrical end portion of the rail then is inserted in the appropriate socket of the t-shaped connector 32, and preferably solvent welded to that T-shaped connector 32 in a customary fashion. In such a manner, the frames which define the portable fence 1 can be easily assembled and the netting 4 attached to the frame, preferably in a positive, interlocking manner as described.

Each frame includes two foot elements 14. These foot elements consist of a t-shaped member 36 that slidably receives a projecting tubular foot 38, which may, for some uses, be approximately 31" long. A set of caps 42 cover the outer ends of foot 38 to provide a finished appearance and to prevent dirt and other foreign matter from becoming lodged in the foot element 14.

The T-shaped member 36 of each foot element is releasably connected to the adjacent t-shaped member 32. In a preferred construction, as shown in FIG. 4, this connection is provided using a plug member 44 which is partially, but mostly received in the upstanding portion of T-shaped member 36, and received to a lesser extent in the downwardly opening portion of T-shaped member 32. In particular, this plug member 44 includes a base portion 46 that is fixed to the upstanding portion of T-shaped member 36, such as by being solvent welded thereto and/or by being riveted or mechanically attached thereto. Above the base portion of the plug member 44 is a reduced diameter portion 48 and, at the top of plug member 44, is a rim portion 50. The diameter of this rim portion 50 is slightly smaller than the inside diameter of the downwardly extending portion of T-shaped member 32. The outer edge of rim portion 50 has an axial length of approximately ⅛". The spacing of rim portion 50 above the top portion of T-shaped member 36 is such (e.g. about 1") that the rim portion will be received in and snugly interfit with the downwardly projecting portion of T-shaped member 32 but, upon application of a predetermined force to the fence 1 and the vertical side rails 12 will, with respect to pivot foot 14, the rim portion 50 will permit the plug member 44 to be dislodged from T-shaped member 32. In other words, the rim portion 50 of plug member 44 is sized and shaped to fit within the T-shaped member 32, but on application of a predetermined force, such as a player running into the fence, T-shaped member 32 will pivot upwardly an away from plug member 44. A resilient elastic cord 52 passes through an opening 53 in plug member 44 and is fixed to the plug member as, for example, by including a loop in the end of the elastic cord 52 and receiving a pin 54 through that loop, which pin 54 is also received at the end of the plug member. Any means can be used to anchor the cord 52 through the plug 44, including having them formed as an integral unit, or forming means at the upper surface of the plug to which the cord 52 may be attached.

Foot 14 may be rotated relative to side rail 12 to position the foot 14 either in the plane defined by the frame of the fence or to extend the foot outwardly, especially at a 90° with respect to the fence 1. The foot 14 is shown at an angle to the fence 1 in FIG. 1, the foot in this position thereby supporting the fence on the ground.

Preferably foot 38 is slidably received within T-shaped member 36 such that it may be moved relative to T-shaped member 36 to position foot 38 such that it projects away from the plane defined by the fence completely in one direction to maximize tipping force resistance moment from the opposite direction from the one in which foot 38 is moved, or it may be moved for example, to be centered under vertical side rail 12 to provide equal tipping force resistance moment in both directions perpendicular to netting 4.

The plug member 44, and the interconnection of plug member and cord 52, is such that it does not interfere with passage of foot 38 through T-shaped member 36 to permit such adjustment.

The elastic cord member 52 extends up through the vertical side rail 12. It has a length of extension necessary to enable it to develop the necessary tensive force. Most elastic cords and springs produce a tensive force which is roughly proportional to their extension. In this case, the amount of extension, and amount of force necessary dictates, for an elastic cord, that a given length be made available for linear displacement with a resulting evenly changing force. It is understood that a spring can be used, the only requirement is that there be enough room for longitudinal stretching that the force profile does not increase rapidly over the range of stretch, as would be the case of a cord or string whose "give", or reserve displacement had already been utilized.

It is further understood that any means can be used to anchor the other end of the elastic cord 52. For example, a small hook could be mounted at the inside surface of the vertical rail 12. Further, the end of the cord may be cemented, attached as by bolting, or even looped to the outside of the vertical rail 12 through an aperture in vertical rail 12.

Referring to FIG. 5, one possible method of securing the upper elastic cord 52 is shown. Here the elastic cord 50 exists at its upper end in the form of a loop. Into the upper end of the vertical side rail 12 is cut a slot 54A resulting in slot surfaces 55 and 56 which support an enlarged pin 57. Enlarged pin 57 fits through the looped upper end of the elastic cord 52 and supports elastic cord 52. Note that for the extruded material making up the vertical side rail 12 that the pin 57 is supported wholly along a section of its radial underside at one of its ends and only partially supported along a section of its radial underside at its other end.

In this configuration, the pin 57 needs to be large enough that it will rest within its slots and not fall completely through the open side of vertical side rail 12. Thus the width of the slot surfaces 55 and 56 must be wider than the open side of vertical side rail 12. Referring to FIG. 6 for explanation, the cross sectional view of the top rail 6 is the same as the cross sectional view of the vertical side rail 12 in FIG. 5. Note that in FIG. 5 that a portion of the flange elements 20 have been removed to accommodate the rounded outer portion of a T-shaped element 32. In FIG. 6, a dashed dividing line 58 is shown to illustrate the plane through which the flange elements 20 are severed.

Once severed, the structure remaining will consist of a tube having an elongate slot. The pin 57 must be large enough not to fall through the resulting slot. The slot 54A must, therefore be larger than the separation resulting from removal of the flange elements 20. In fact, pin 57 can be quite large, and can be made of any shape. In accord with FIG. 5, the pin 57 is of sufficient length to nestle itself within the slot surfaces 55 and 56 but without overlapping the outer diameter surfaces of the vertical rail 12, so that the T-shaped member 32 can be fitted over the upper end of vertical rail 12. Ideally, pin 57 will be long enough that the inner surfaces of the T-shaped member will prevent any significant axial motion of the pin 57 from causing disengagement from its slot surfaces 55 and 56.

It is also understood that the pin 57 may be an oversized pin which may extend beyond the outer surface of vertical rail 12 and that a slot might instead be formed in the lower portion of T-shaped member to accommodate the protruding sections of the pin 57. In all of the aforementioned situations, the T-shaped member atop vertical rail 12 may be removed without disturbing the upper end of the elastic cord 52.

Figure 5A:
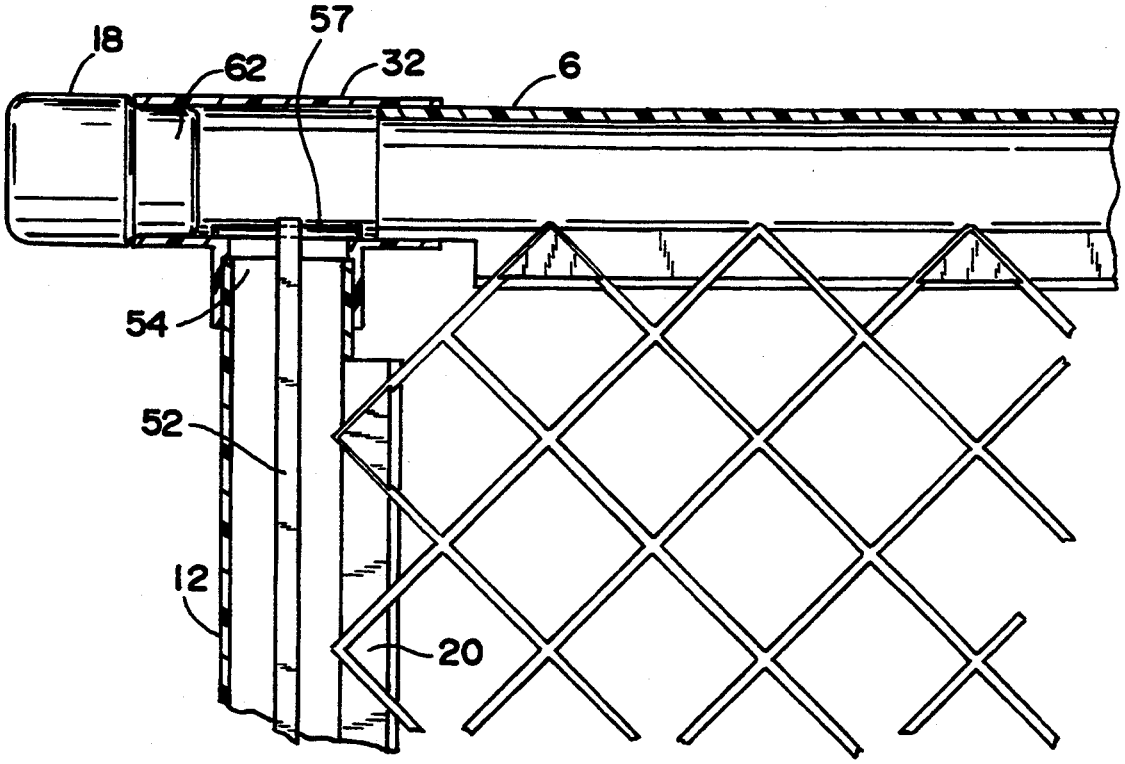
FIG. 5A is a cross-sectional view of the upper corner portion of the fence taken on lines V—V of FIG. 1 and illustrating a second possible way in which an elastic member may be supported.

A second configuration is shown in FIG. 5A in which the elastic cord 52 bears downwardly against the T-shaped member 32, and in which the T-shaped member atop vertical rail 12 may not be removed without disturbing the upper end of the elastic cord 52.

Referring to FIG. 5A, the elastic cord 52 is shown extending upwardly into the T-shaped member 32. In this configuration, no slots need be cut into the vertical side rail 12, nor into the lower portion of T-shaped member 32. The upper end of the loop of the elastic cord 52 can be drawn upwardly through the vertical side rail 12 and outwardly through the outside opening of T-shaped member 32, which is shown in FIG. 5A as being covered by an end cap 18. Here, pin 57 resides within the upper T-shaped member, even though it is shown as being somewhat abbreviated in length. Actually, pin 57 can be much larger in diameter and longer in order to lessen the probability that it will move axially and fall from its resting place, and through the vertical side rail 12. Note that the portion of the end cap 18 which enters the T-shaped member 32 is abbreviated to accommodate the length of the pin 57. The central idea in FIGS. 5 and 5A is that the elastic cord 52 may be supported within the vertical side rail 12 by any means.

Of course, various other resilient connectors may be employed if desired. For example, resilient cord 52 may be replaced by a spring centrally located within side rail 12 and connected to the top and bottom plugs by cables.

The T-shaped members 32 connecting top rail 6 with side rail 12 each incorporate an outwardly projecting opening 62 into which end cap 18 was placed. Instead of making end cap 18 of a hard material, it may be made of a foam plug material. This foam plug end cap 18 may be squeezed somewhat and inserted into this opening 62, then squeezed and inserted into a similar opening at top of an adjacent section of the portable fence 1, joining two fence 1 sections as was shown in FIG. 1. Such a collapsible foam plug thereby releasably interlocks adjacent sections of the fence 1, since a significant shear force or an axial force would cause the sections to lose interlock.

In certain applications, it may be preferred to interconnect adjacent fence sections in a positive, non-slidable fashion, such as by using threaded elements that screw into the opposed openings 62 of adjacent fence sections.

In use, should a player run into a section of the fence 1, the interconnection of foot 14 with side rail 12, and the foam plug members interconnecting the top rails of adjacent sections of the fence 1 (such as in FIG. 1, where the foam plug portions are not shown) is such that the force applied by the player will cause plug members 44 to pop out of t-shaped members 32 which receive them, and foam plug end caps 18 to pull from adjacent sections of the fence 1, thereby permitting only the section with which the player has collided to collapse to the ground, the player's momentum carrying the player past the collapsed fence 1 section to the field beyond. Accordingly, the players need not be concerned about colliding with the fence 1, for they will not cartwheel over it but can instead cause it to readily collapse to the ground, permitting the player to pass through the area over a horizontally flat fence.

Yet the fence clearly defines the boundaries of the playing field for both the players and the spectators. Thus, a ball hit over the fence 1 will be a home run. Moreover, a ground ball which gets past outfielders which does not clear the fence 1 will not continue rolling, permitting the batter to circle the bases, but instead will strike the fence and be deflected back into the playing field, permitting the outfielders to field it and limit the passage of the batter around the bases.

When a player has collided with, and collapsed, a section of the portable fence, the fence panel 1 may be easily restored to its original, upright position. All the player or grounds keeper need do is lift the fence into a position which will enable the resilient cords 52 (or springs) to cause the foot 14 to snap back into place, and the fence 1 panel then becomes repositioned. The foam plugs can then be reinserted to enable re-connection of adjacent sections of the fence, all in a few moments time. Thus, the first embodiment of the portable fence 1 is safe, and is easily positioned and interconnected.

The vertical intermediate supports 16 preferably are formed each as a tubular elongated element (see FIGS. 3 and 6) that includes, at each end, a fitting 72. This fitting 72 is shaped as a tubular cup, the top rim or margin of which is fitted, as with an indentation, to merge with the upper and lower rails 6 and 8. The sides and middle portion of the fitting 72 have notches 73 to fit about, and receive, flanges 20 of the rail, in this case upper rail 6. Projecting away from the cup is a cylindrical stub 74 that fits within the end portion of the intermediate support 16. Preferably the upper cup portion of the fitting 72 is solvent welded to the rail 6 and the end of support 16 is also solvent welded to stub 74, thereby positively connecting these members to one another (although any other appropriate type of connection may be employed if desired). The netting 4 stretches about and passes over one side of the vertical intermediate supports 16.

For example, one configuration which requires a greater number of panels is a setup of a men's slow pitch softball game. The outfield fence for a standard men's slow pitch softball field is approximately 300 feet from home plate. Accordingly, the fence itself will be about 480 feet long. By using fencing sections made in accordance with the preferred embodiment of the present invention, in ten foot lengths, 48 of the sections will constitute a complete outfield fence. These sections may be stored and transported on a single trailer, and may be easily set up on the playing field, either by a grounds keeper or by the players themselves.

The portable fence of the present invention is designed to permit advertising signs or banners placards to be attached to the fencing between the top and bottom rails, as generally indicated in FIG. 1. As a result, teams may induce sponsors to purchase space on sections of the fence by permitting them to place advertising on these sections, yet the advertising will not interfere with the operation of the fence, nor with its storage or transport.

Figure 8:
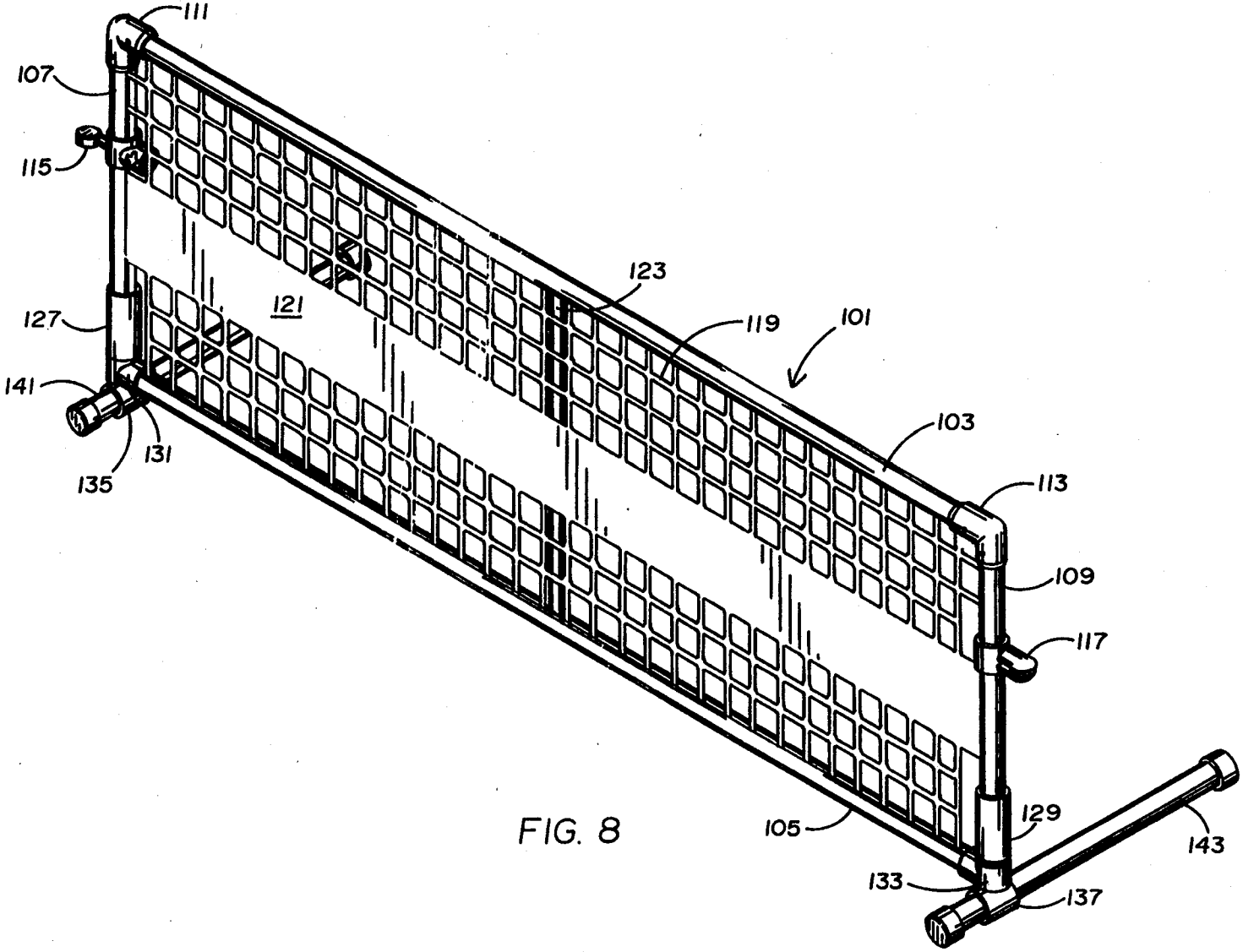
FIG. 8 is a perspective view of a second embodiment of the fence of the present invention.
Figure 9:
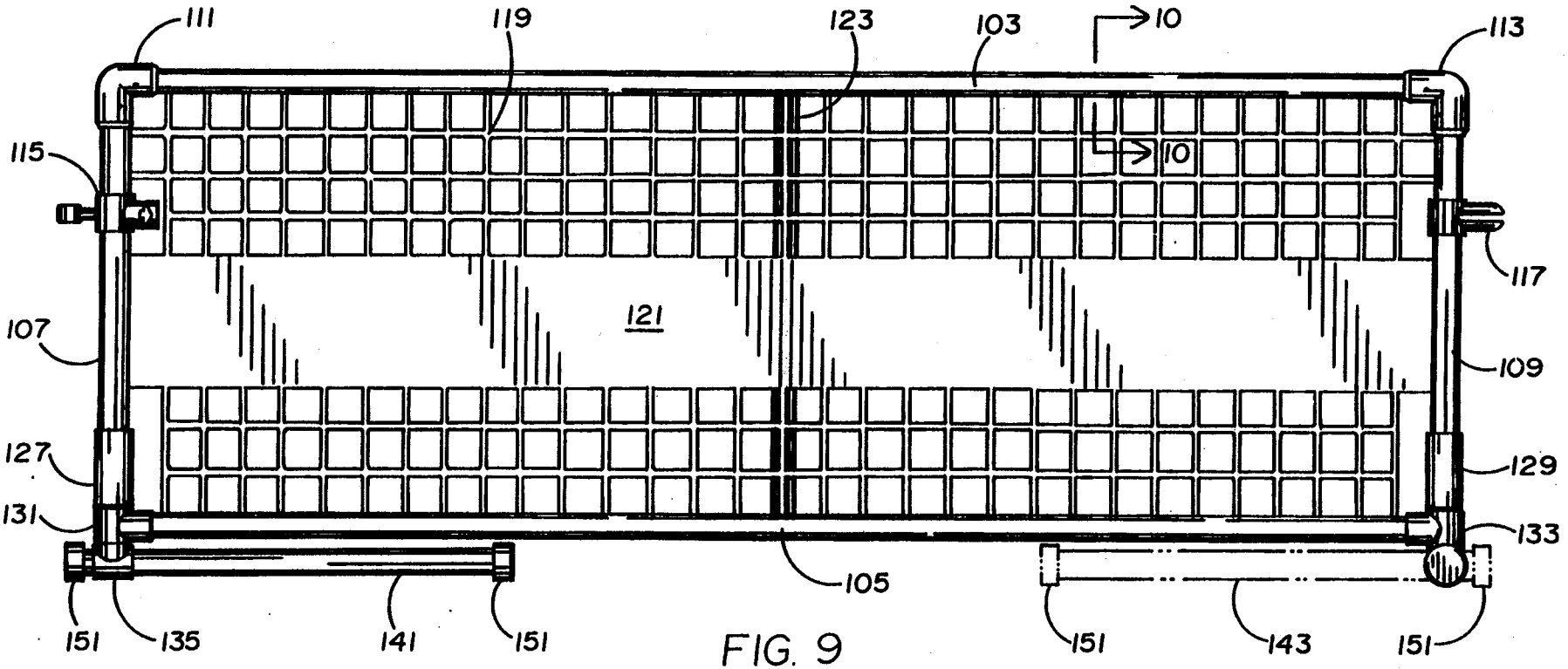
FIG. 9 is a plan view of a second embodiment of the fence of the present invention.

A second embodiment of the fence of the present invention is illustrated beginning with FIG. 8 which illustrates a perspective view of the second embodiment, and FIG. 9 which illustrates a plan view of the second embodiment. This fence section 101 includes a horizontal upper rail 103, a horizontal lower rail 105, a vertical side rail 107 shown in the left portion of the FIG. 8, and a vertical side rail 109 shown in the right portion of the FIG. 8. The upper rail 103 is attached to the vertical side rails 107 and 109 by a pair of right angle elbows 111 and 113 respectively. These elbows 111 and 113 are standard tubular fittings which may be solvent welded in a manner previously mentioned.

On the vertical side rail 107, about ⅔ the way up the rail is a male duckbill connector 115. On the vertical side rail 109, about ⅔ the way up the rail is a female duckbill connector 117. These will be discussed in great detail in subsequent Figures. Between the vertical side rails 107 and 109, and the upper and lower rails 103 and 105 is the netting 119.

Netting 119 has cells which have several notable characteristics. The structural members making up the cells are not linear, but tend to narrow along the extension between adjacent nodes. This forms cell space resembling a rounded surfaced rectangle having rounded corners, or somewhat of an older television screen shape. Further, the netting 119 can consist entirely of identical cells, or it can be interrupted with a flat area 121, as shown in FIG. 8, which is especially useful for accommodating graphics and advertising.

It is understood that netting 119 can exist entirely of identical cells, or it may have flat areas 121 of different shapes. Individual cells can be filled in to form flat areas where needed to permanently form a design, logo, or to spell out a word. Just behind the netting 119 can be seen a vertical support 123. It is further understood that the fence section 101 can be made of different heights and lengths. Illustrated in FIG. 8 is a shorter section requiring a single vertical support 123. A longer version of the fence section 101 may require 2 or 3 vertical supports 123 in order to provide appropriate structural stability.

Note the base of the fence section 101. A reinforced collar 127 is coaxial with the vertical side rail 107, while a reinforced collar 129 is coaxial with the vertical side rail 109. Beneath the reinforced collar 127 is a T-shaped connector 131 where the arms of the "T" are so abbreviated as to be virtually non-existent. It is a "T" shape because it defines a pair of flow channels, one of which has an axis terminating in the wall of the other, while the other flow channel passes straight through. The straight through portion of the T-shaped connector 131 is co-axial with the vertical portion of the vertical side rail 107. The terminated flow channel portion of the T-shaped connector 131 is co-axial with the lower rail 105. Likewise beneath the reinforced collar 127 is a T-shaped connector 133 having a mirror orientation with T-shaped connector 131.

Beneath the T-shaped connector 131 is a T-shaped connector 135, which may be identical to T-shaped connectors 131 and 133. T-shaped connector 135, however has its flow terminating axis co-axial with the axis of vertical side rail 107. Likewise, a T-shaped connector 137 lies beneath T-shaped connector 133, and is co-axial with vertical side rail 109. The through channels of the T-shaped connectors 137 and 139 each accommodate foot elements 141, and 143, respectively.

The foot elements 141 and 143 may be angularly and linearly displacable as was the case for foot elements 14 with respect to the first embodiment of FIG. 1–7. That is, the foot element 141 is slidable within the T-shaped connector 135 in order to maximize the resistance to the tipping moment to one side of the fence section 101, or the foot element 141 can be axially displaced to the center of the T-shaped connector in order to balance the standing forces of the fence section 101. The same is true for foot element 143 with respect to the T-shaped connector 137. Foot elements 143 and 141 each have an enlarged diameter portion 151 at their ends to limit the end of travel of the foot elements 143 and 141. The right most portion of FIG. 9 illustrates foot element 143 in dashed line format when folded in the same plane as the fence section 101, and in solid line format when rotated perpendicular to the plane of the fence section 101. Further details of the fence section will be discussed as the Figures permit.

Figure 10:
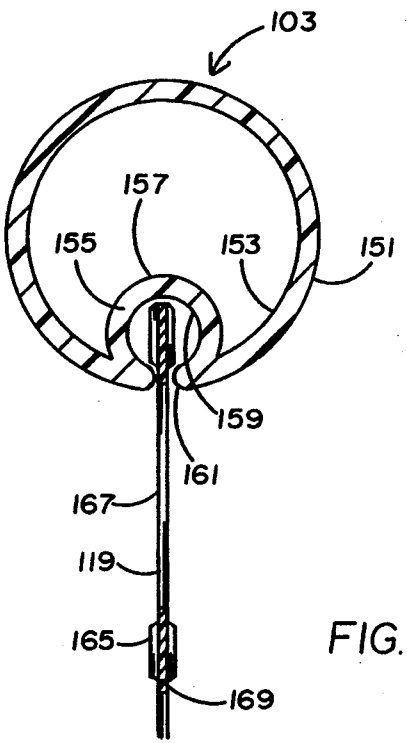
FIG. 10 is a cross sectional area of the upper portion of the second embodiment of the fence of the present invention taken along line 10—10 of FIG. 9.

Referring to FIG. 10, a sectional view of the fence 101 along line 10—10 of FIG. 9 shows the double circle cross section extruded nature of upper rail 103 interface with the netting 119. Although upper rail 103 is illustrated, any of the other structures, namely lower rail 105, or vertical side rails 107 and 109, could be used to show the interface between the netting 119 and rail structures.

In FIG. 10, the upper rail 103 has a round outer surface 151 which is visible in FIGS. 8 and 9, and an inner surface 153. Within the area defined by the inner surface 153 is a second structure 155 having an outer round surface 157 and an inner surface 159. These structures do not share a common radial center, but do share a common gap in their cross sectional circular extent. A slot 161 has an axis parallel to the axes of upper rail 103 and second structure 155.

Upper rail 103 and second structure 155 are illustrated as having cross sectional areas in the form of two circles, one inside the other, and which would tangentially touch each other at a common point were they continuous. However, both upper rail 103 and second structure 155 have cross sections which define a gap, the gap being in common to both circular cross sectional areas. The portions of their structure which are adjacent the gap, or a slot 161 as would be seen in a perspective view, are continuous. Thus, atmosphere outside the upper rail is in communication with the atmosphere inside structure 155. The space between inside structure 155 and upper rail 103 is sealed off along the length of upper rail 103, and indeed the lower rail 105, and vertical side rails 107 and 109.

Also shown in FIG. 10 is a side sectional view of the netting 119. The netting 119 shown in FIGS. 8 and 9 comprises a series of vertical and horizontal members which have common areas, called nodes, at places where the vertically extending members and horizontally extending members of netting 119 cross. With regard to the orientation in which section 10—10 was taken, FIG. 10 illustrates a node 165 supported by a vertical netting member 167. A horizontal netting member 169 is shown in section between the width of the node 165. Further, the nodes 165 in the netting 119 themselves are not flat. Each node has a rectangular raised area, which in FIG. 10 only shows two dimensions of each side.

The netting 119 is either cut or manufactured in a way that the edge of the netting contains a series of the nodes 165. In this way, a series of nodes can be slidably inserted into the round structure 155 in order that the edge of the netting 119 be held with respect to the appropriate rail. Note that the width of the slot 161 is sufficient to permit entry of the vertical netting member 167, but not of such width to allow node 165 to pass through. In this manner, an extruded rail, such as upper rail 103 can slidably accept an entire row of nodes 165. When the rails are Joined, either by the right angle elbows 111 and 113 or the T-shaped connectors 131 and 133, the netting 119 will be trapped, and only axial movement of the rails will free the netting 119.

Netting 119 may be manufactured in a variety of thicknesses and configurations to accommodate a wide range of advantages. It has been found that the sections of netting 119 which include the flat area 121 often made of thinner sheeting which results in thinner nodes 165. In the event that a choice of materials results in a node thickness thinner than necessary for a positive engagement of the netting 119 with the rails 103, 105, 107, and 109, an additional structure can be employed. A series of nodes 165 of lesser thickness can be dealt with in a slightly different manner, using a small, more closely dimensioned retaining member to be slipped over the outside nodes 165 as will be subsequently discussed.

The netting 119 may be made of a heat-shrink material which is available in a pre-stretched configuration. This pre-stretched material is installed in the various rails and then heated in order to eliminate the slack in the netting 119. This is typically accomplished with a heat gun, blow dryer, or oven. Alternatively, the netting 119 may be constructed so that it will stretchably yield as the various rails are fitted together.

Figure 11:
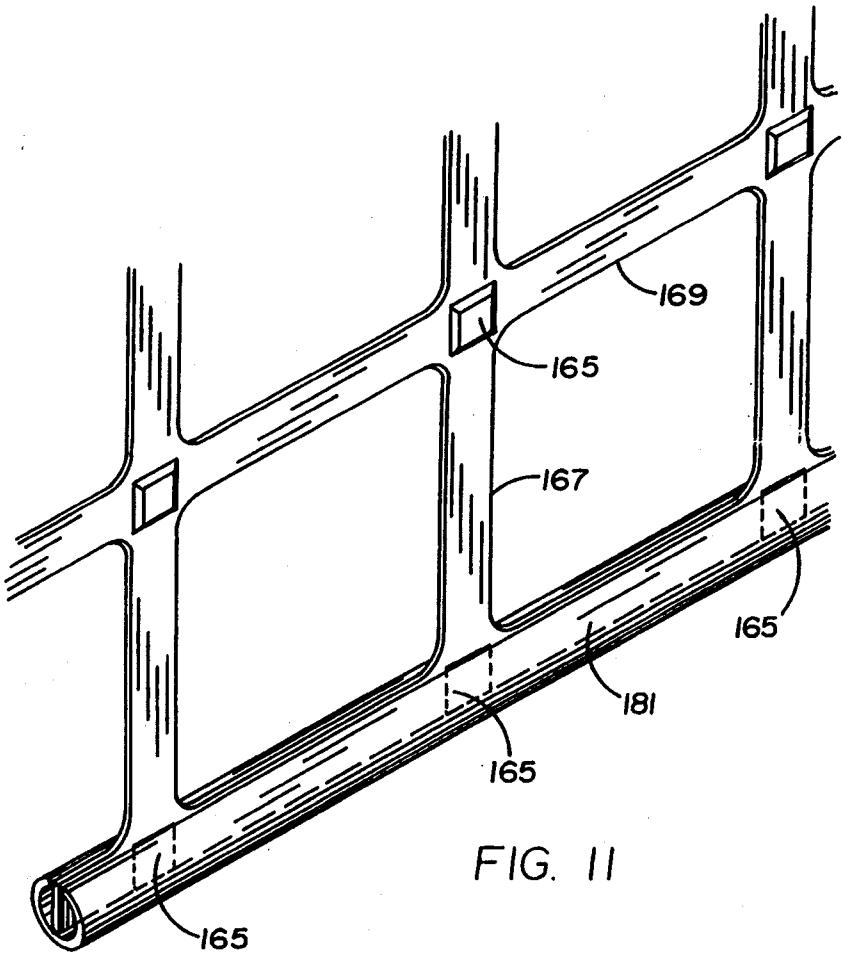
FIG. 11 is a perspective view illustrating the use of a retainer member to more securely fit the netting of the fence of the second embodiment into one of the fence's support rails.

The use of a retaining member for further strength of fit between the rails and the netting 119 can also be accomplished. Referring to FIG. 11, a retainer member 181 has been slipped over a row of nodes 165. Because the retainer member is a single circular layer, preferably of metal, such as aluminum, it can be slid over a row of nodes 165 before insertion into vertical side rails 107 and 109, or horizontal upper and lower rails 103 and 105. The retainer member is especially useful for areas the edges of the netting 119 adjacent flat areas 121 which may bear nodes 165 which are not as thick in dimension as nodes occurring along the outer edge of a the non-flat portion of the netting 119. Yet when the retainer member 181, and its associated captured nodes 165 are slid into the round structure 155, the slot 161 is not wide enough to permit the retainer member to pass through.

Figure 12:
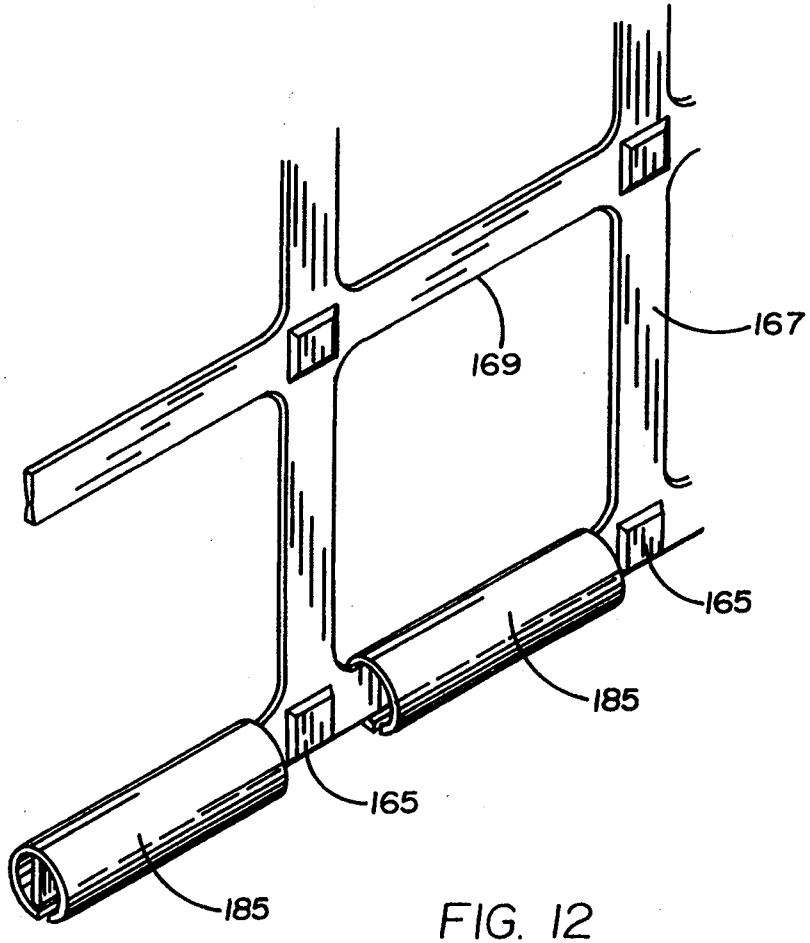
FIG. 12 is a perspective view illustrating the use of a short retainer member to more securely fit the netting of the fence of the second embodiment into one of the fence's support rails.

Referring to FIG. 12, the retainer member 181 is replaced by a series of short retainer members 185, which may be made of plastic and are able to fit over the horizontal netting members 169 between the nodes 165. Here, instead of providing a retainer member 181, the abbreviated length of the short retainer members 185, they can be positioned such that the solid portion of their length opposes the slot 161. In this configuration, the horizontal netting members 169 will be held as tightly in place by the rails as the short retainer members are more securely held by the round structure 155.

The manner in which the second embodiment of the fence 101 operates is different than that of the first embodiment. In the first embodiment, the plug member 44 had an axis in the vertical direction. Here, the plug member will have an axis in the horizontal direction, and actually reside within the foot elements 141 and 143.

Figure 13:
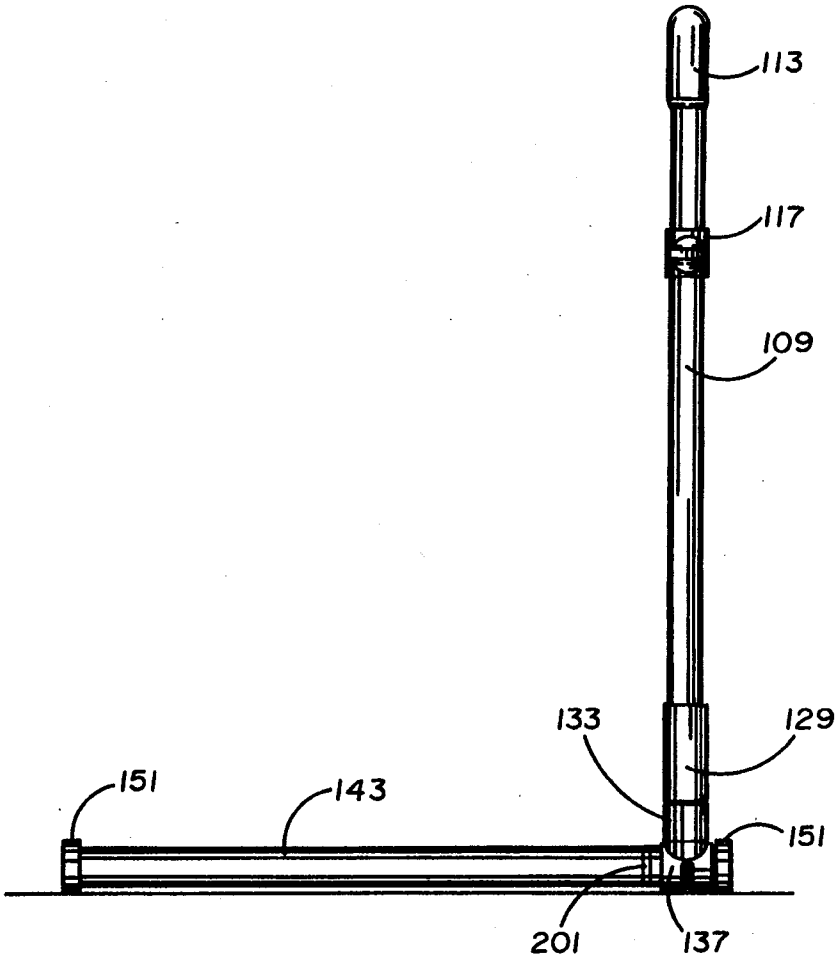
FIG. 13 is a side view of the fence of the second embodiment in a position to break away and fall flat upon receiving a force originating from the right side of the FIG. 13.

Referring to FIG. 13, a side view of the fence 101 illustrates a closer look at foot element 143. The majority of the foot element 143 is a long tube to the left of a break line 201. Break line 201 is the plane about which the break away action occurs. In the position shown in FIG. 13, the fence 101 is configured to break away and fall flat on impact occurring from right to left with respect to of the FIG. 13. If the foot element 143 were moved axially approximately one half of its length to the right to displace break line 201 near the outer extended tip of the foot element 143, the fence would be in a permanent standing configuration.

Figure 14:
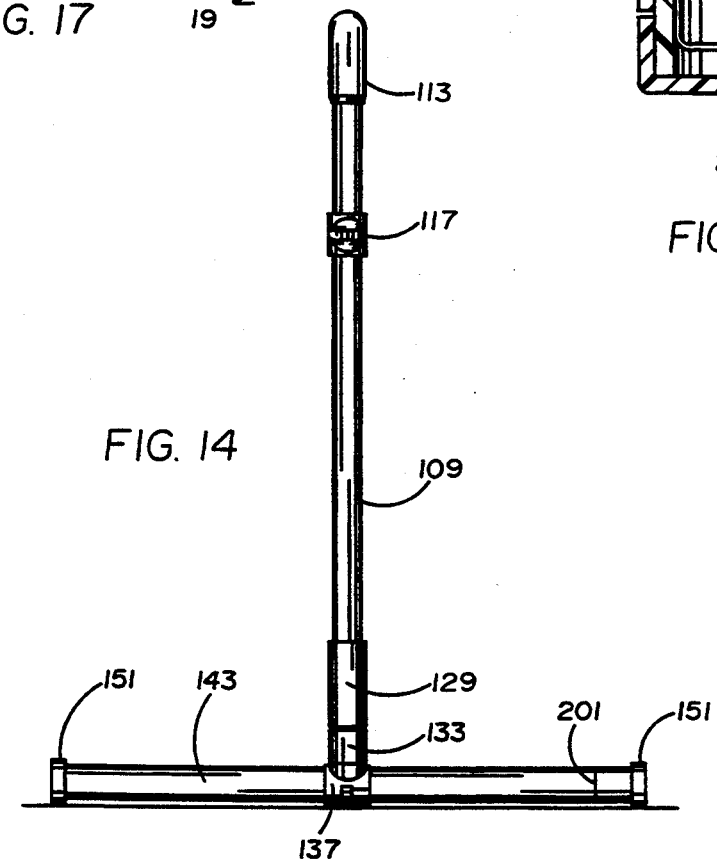
FIG. 14 is a side view of the fence of the second embodiment in a balanced position in which the break away feature is disabled.

In a permanent standing configuration changed from that shown in FIG. 13 and of the type just described, a force coming from the right of the FIG. 13 would cause the fence 101 to tip to the left. A force coming from the left of the FIG. 13, in the configuration changed from that shown in FIG. 13, a large bending moment would have to be over come before the fence 101 would tip upward and back onto its foot element s 141 and 143. In this manner the fence 101 can be put into a crowd control position having maximum resistance to force in one direction. Of course, if the foot element 143 and foot element 141 were to be moved to their middle position, the fence 101 would oppose tipping with equal amounts of force on both sides. This configuration is shown in FIG. 14.

Figure 15:
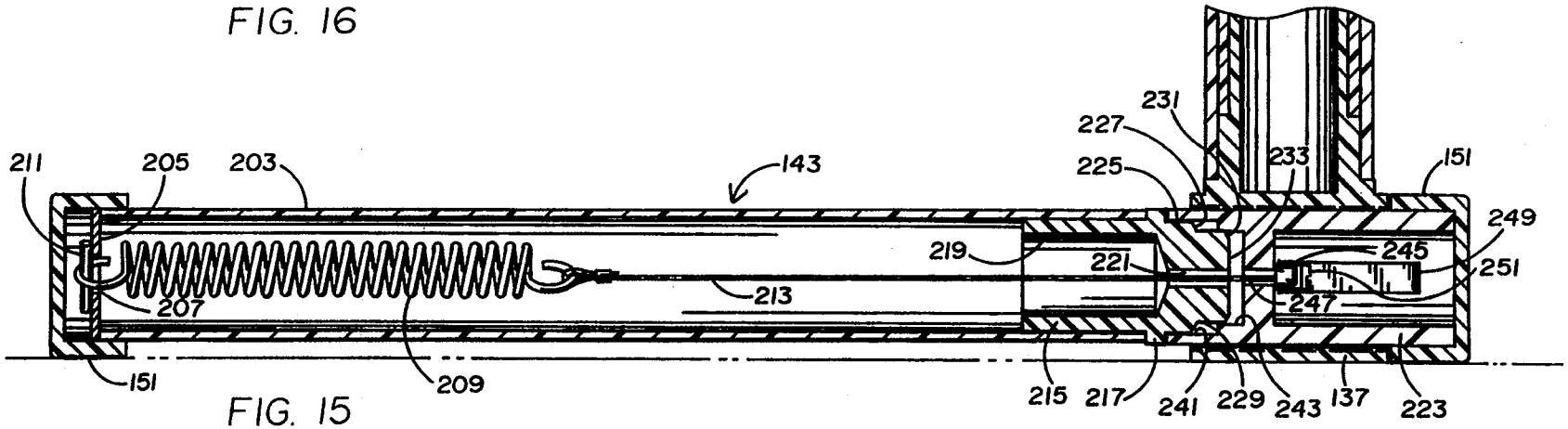
FIG. 15 is a side sectional of the footing shown from the perspective of FIG. 13.

Referring to FIG. 15, a side sectional view of footing 143 from the same but expanded perspective of FIG. 13 shows the internals of the breakaway mechanism. Beginning at the far left, the enlarged diameter portion 151 can be seen to be, in this instance, a cap covering an elongate tube 203 which forms the majority of the length of the footing 14. At the end of the tube, just inside the enlarged diameter portion, is a steel washer 205 having a diameter larger than the inside diameter of the tube 203, but less than or equal to the outer diameter of the tube 203.

The washer 205 has a central aperture 207 through which the loop end of a metal spring 209 extends. The spring 209 is under tension, however, it is held fast by the washer 205 by means of a retainer pin 211. Retainer pin 211 should be significantly longer than the diameter of the central aperture 207 to reduce the chance of disengagement of the retainer pin 211 from the end of the spring 209. Ideally, if the pin has a greater length than the length from one edge of the aperture to the opposite side of the inner wall of the enlarged diameter portion 151, the pin cannot release the spring unless the enlarged diameter portion 151 is removed.

The other end of the spring 209 is attached to a cable 213 which extends through the tube 203 near its center. At the other end of the tube 203 is a plug 215. Plug 215 has a main body diameter less than that of the internal diameter of the tube 203 and raised land 217 larger than the internal diameter of the tube 203 in order to fit within tube 203 up to the extent of the land 217. Plug 215 includes a hollowed out portion 219 in order to accommodate cable 213. Plug 215 also includes a central aperture 221 to allow cable 213 to pass entirely therethrough.

The outside surfaces of the plug 215 are stepped in order to provide a measured disengagement with an abutting break member 223. Break member 223 may be formed integrally with the enlarged diameter portion 151, or enlarged diameter portion 151 may be added like the cap shaped enlarged diameter portion 151 shown in FIG. 15.

From the land 217, the external surfaces of plug member 215 abutting break member 223 include a first cylindrical surface 225, adjacent an angled stepped surface 227, adjacent a second cylindrical surface 229, adjacent a beveled end surface 231, adjacent an end surface 233 perpendicular to the axis of the tube 203. The inside surfaces of break member 223 are only partially complementary to the surfaces of the plug member 215.

Break member 223 includes a first internal surface 241 having an internal diameter sufficient to accommodate first cylindrical surface 225, and a second internal surface 243 having an internal diameter sufficient to accommodate second cylindrical surface 241. However, land 217 bears upon the outer rim of the plug member 215 limiting the distance in which plug member 215 may be axially displaced within break member 223. As a result, the majority of the second internal surface 243 of plug 215, and a portion of the first and second internal surfaces 241 and 243 of the break member 223 are adjacent an open space rather than the opposite member. The end of the cable 213 is held in place due to the presence of a crimp member 245 which is crimped about the end of the cable 213, and has a diameter too large to enable it to pass through an aperture 247 in the break member 223. In addition, and as shown in FIGS. 15 and 16, the T-shaped member 137 may have a spring 249 urged chamfered button 251 through a slot (not shown) to insure that the foot element 141 remains locked in a position with respect to T-shaped member 137 enabling the fence 101 to be stabilized to operate exclusively in a break away fashion.

Thus from FIG. 15, it can be seen that the spring 209 and cable 213 urge the break member 223 over the end of the plug 215, and, along with the shapes of the break member 223 and plug 215, enable enough of the surfaces of break member 223 and plug 215 to interact to give a sturdy fit, separable only upon sufficient force from player contact.

Figure 16:
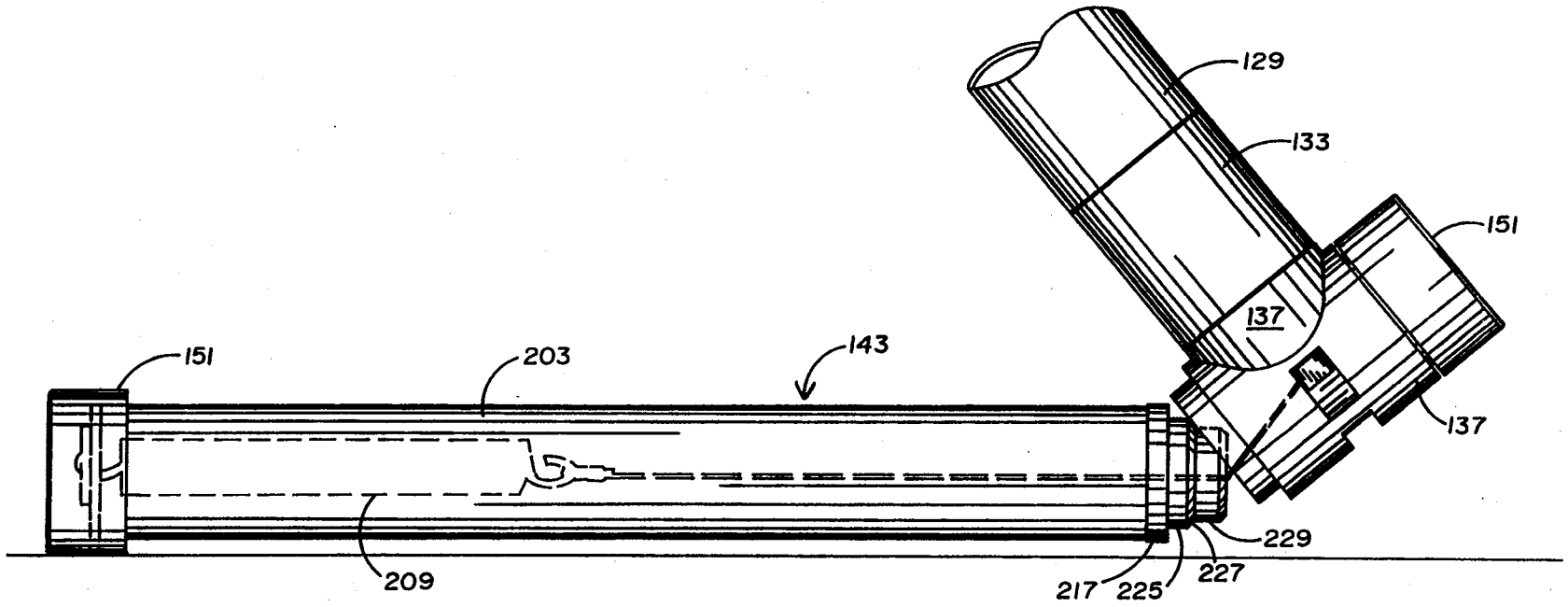
FIG. 16 is a side view of the footing shown in FIG. 15, but shown in the position of breaking away.

Referring to FIG. 16, the foot element 143 is shown in a broken away position. Note that the break member 223 has become dislodged from the plug 215, but that these two members are still connected by the cable 213 which is under tension due to its being urged due to the resistance of axial stretching of spring 209. In this configuration, much like that of the first embodiment, the fence 101 need only be lifted to an approximate vertical position for the spring 209 to urge the break member 223 back into a engaged position with respect to the plug 215.

Figure 17:
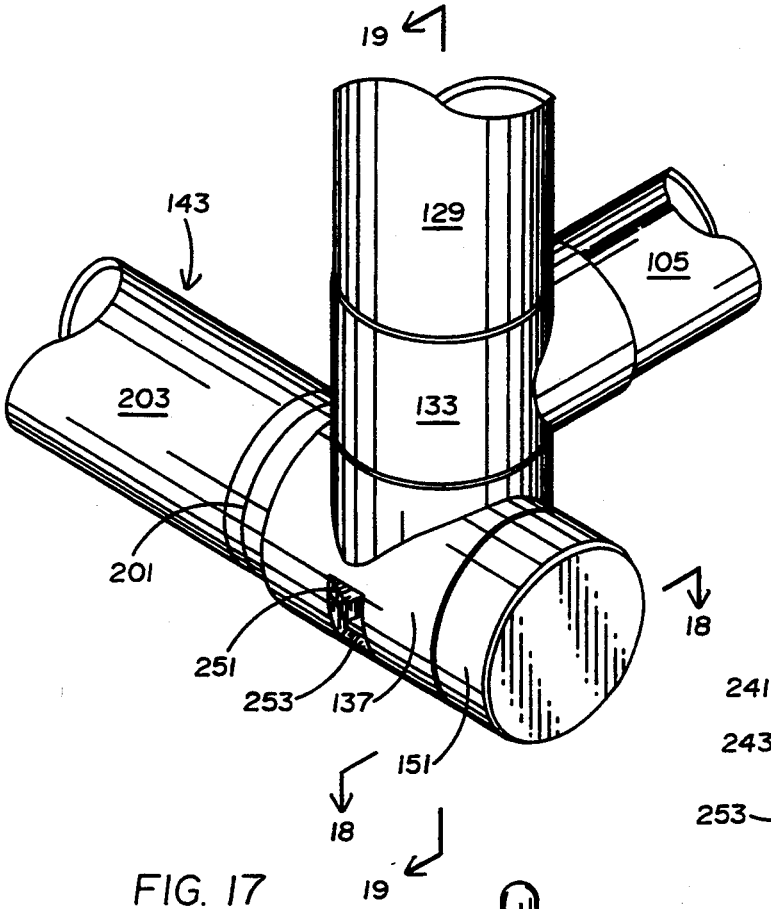
FIG. 17 is a perspective of the lower portion of the footing shown in FIGS. 15 and 16, but in a fully assembled, non-broken away form.

Referring to FIG. 17, a perspective of the corner of the fence section 101 illustrates in greater detail the relationship of the foot element 143 with respect to the T-shaped connector 137. In particular, a slot 253 can be seen engaging chamfered button 251 operated by spring 249 shown in FIG. 15. In this configuration, the fence section 101 is locked into a position where the breakaway mode will operate. This locking configuration insures that, especially where the fence section 101 is to be used more consistently for sports play, the break away and fall flat function will not be inadvertently disabled by personnel handling the fence sections 101.

Figure 18:
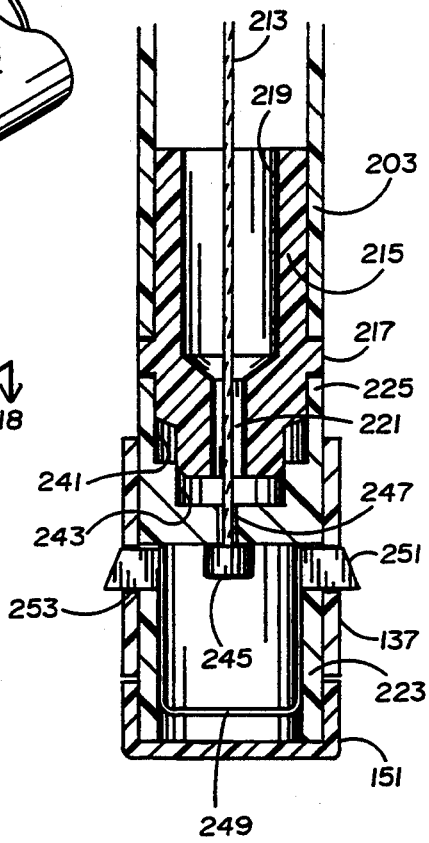
FIG. 18 is a sectional view taken along line 18—18 of FIG. 17.

Referring to FIG. 18, a downwardly looking sectional view taken along line 18—18 of FIG. 17 is illustrated. The relationships between the plug 215 and the tube 203 are clearly shown. The spring 249 is bisected and shown extending along the walls of the break member 223 and across its diameter. The chamfered buttons 251 operate by flexing inwardly against the spring 249 to enable the outer edges of the chamfered buttons 251 to clear the slots 253 sufficiently for the foot element 143 to slide axially within the T-shaped connector 137.

Figure 19:
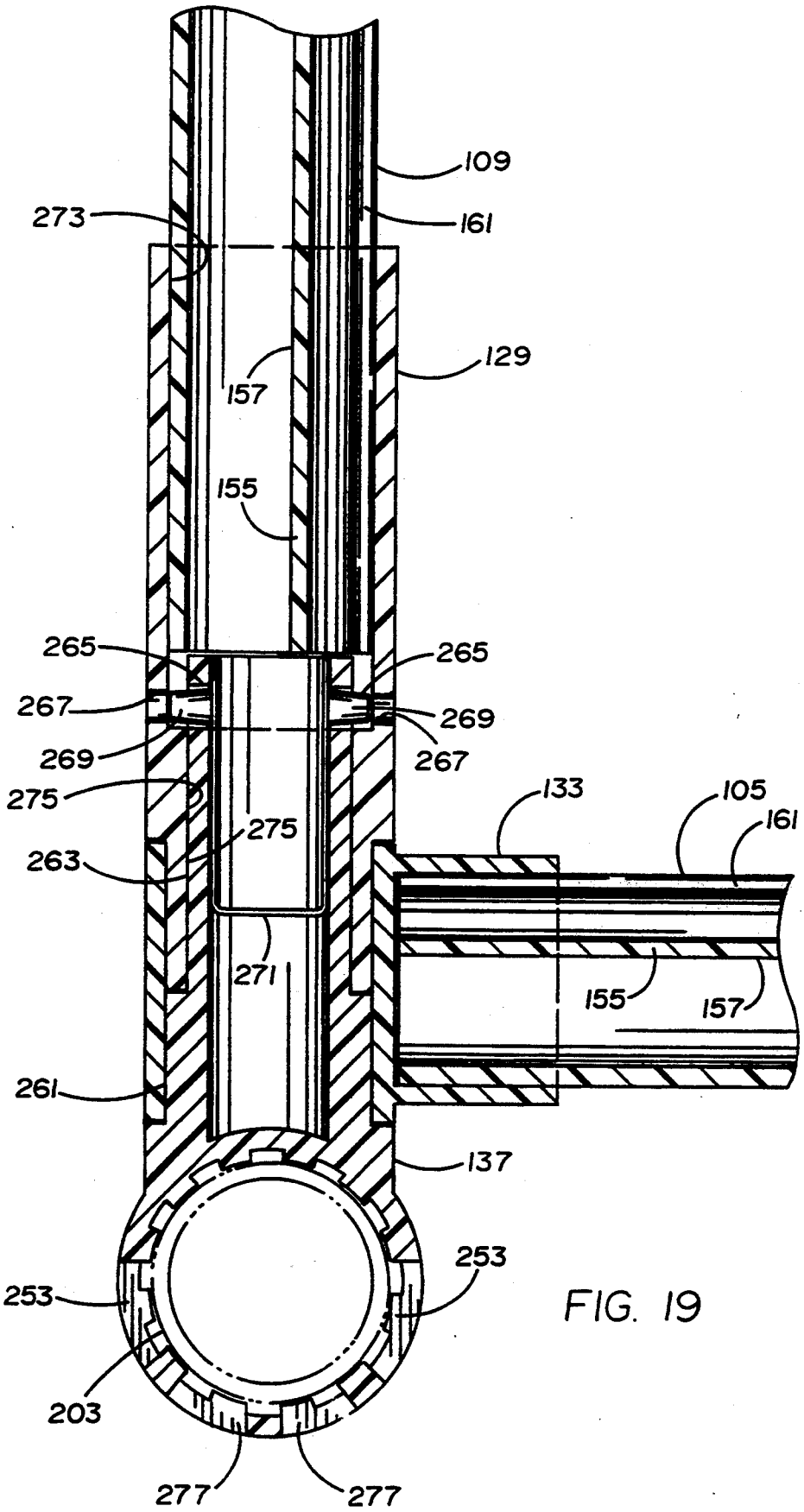
FIG. 19 is a sectional view taken along line 19—19 of FIG. 17.
Figure 20:
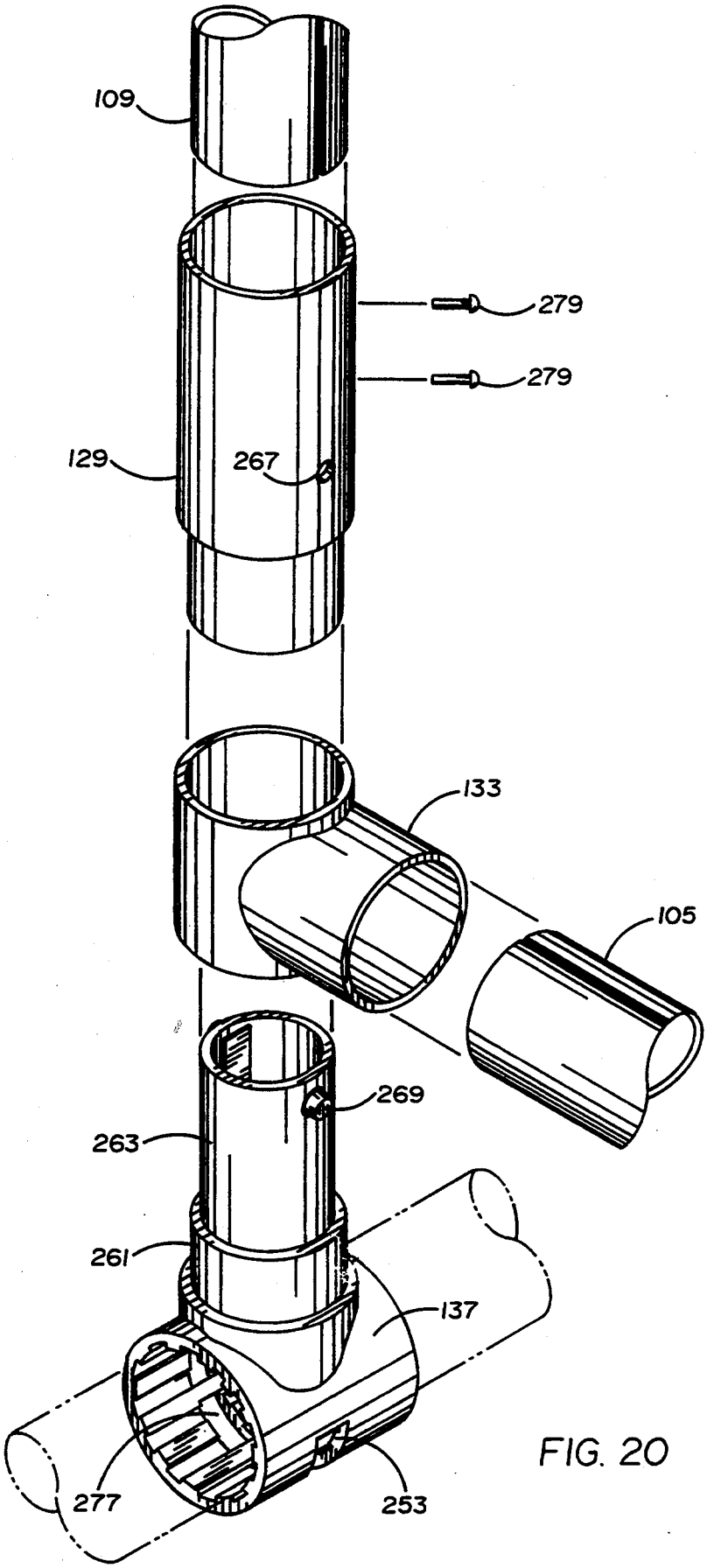
FIG. 20 is an exploded view of the lower portion of the footing shown in FIGS. 16 and 17.

Referring to FIG. 19, a sectional view taken along line 19—19 of FIG. 17 is illustrated. From the right, the lower rail 105 is received within the terminated channel of T-shaped connector 133, and is preferably affixed by solvent welding or mechanical attachment. The lower non-terminated channel of the T-shaped connector 133 receives the end of the terminated channel of T-shaped connector 137.

As can be seen in FIG. 19, the upper end of the terminated channel of T-shaped connector 137 has a first concentrically inward stepped surface 261 which accommodates the internal surface of T-shaped connector 133, and a second concentrically inward stepped surface 263 which accommodates the internal surface of reinforced collar 129. The upper end of the terminated channel of T-shaped connector 137 also carries a pair of oppositely disposed apertures 265 having collinear axes which are perpendicular to the axis of the upper end of the terminated channel of the T-shaped connector 137. Likewise, reinforced collar 129 also carries a pair of oppositely disposed apertures 267 having collinear axes which are perpendicular to the axis of the reinforced collar 129, and which are in alignment with apertures 265.

A pair of lock buttons 269 are Joined by a spring 271 and fit within both the apertures 265 and 267. Within the upper portion of reinforced collar 129, the vertical side rail 109 is received and affixed as by solvent welding or mechanical attachment. In the configuration shown in FIG. 19, the lock buttons 269 can be depressed with a thin object, such as a pencil to cause the reinforced collar 129 to become axially disengaged from the upper portion of the T-shaped member 137. This releasing mechanism is especially advantageous where the fence section 101 is needed to be disassembled for repair of the structures over the foot elements 141 and 143.

Note that the internal diameter of the reinforced collar has a first internal diameter 273 to accommodate the outside diameter of the vertical side rail 109. As second internal diameter 275 accommodates the outside surface 263 of the upper portion of the T-shaped member 137. The stepped transition between the first and second internal diameters 273 and 275 is engaged by the springingly outwardly urged lock buttons 269 to keep reinforced collar from being axially upwardly displaced with respect to T-shaped member 137.

Figure 21:
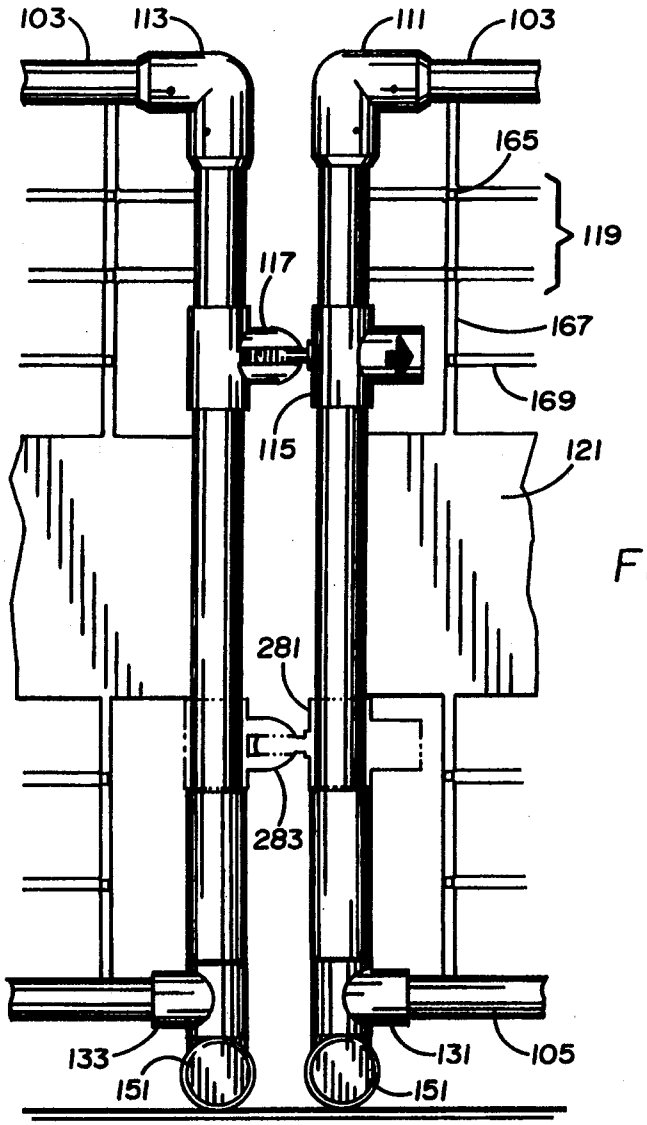
FIG. 21 is a plan view of two adjacent sections of fencing connected by a male and female duckbill connector and showing an additional position for an additional connector.

T-shaped member 137 also contains a series of lower slots 277 to facilitate the gravitational dropping away of any particulates which may collect between the T-shaped member 137 and the tube 203 of the foot element 143. Referring to FIG. 21, an exploded view of the detail shown in FIG. 19 is illustrated. Also shown are a pair of rivets 279 which may be used in lieu of or in addition to the solvent welding necessary to hold vertical side rail 109 within the upper portion of reinforced collar 129.

Referring to FIG. 21, a pair of fence sections 101 are shown in a joined position. The male duckbill connector 115 is shown in connected fashon with the female duckbill connector 117. An alternative position for these connectors which may be used either instead of or along with the male and female duckbill connectors 115 and 117 is shown with the numerals 281 and 283. Having a pair of the duckbill connectors 115 and 117 on one end of the fence section 101 is advantageous when relative angular displacement of two adjacent sections of the fence section 101 is undesirable (while in crowd control position). One such use would be in the case of a day care center which could use the fence sections 101 to create an isolated play section. A minimum of three fence sections 101 could provide such an isolated play section by themselves. In a day care use, it is important that one section not pivot with respect to an adjacent section since a child could slip through the resulting wedge-shaped opening. Since the spacing at the bottom of the fence sections 101 and between adjacent sections 101 is less than that required to admit a baseball therebetween, the fence sections 101 will perform well in a day care situation. The details of the duckbill connectors will be shown in the subsequent Figures.

Figure 22:
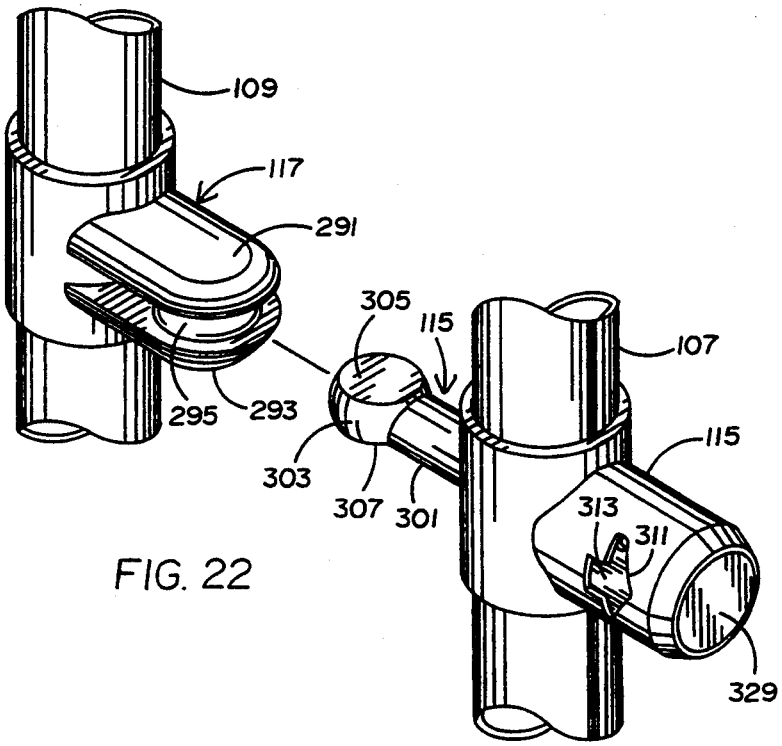
FIG. 22 is a perspective view of two adjacent sections of fencing and their associated male and female duckbill connectors which are tamper resistant, in position to achieve interconnection.
Figure 24:
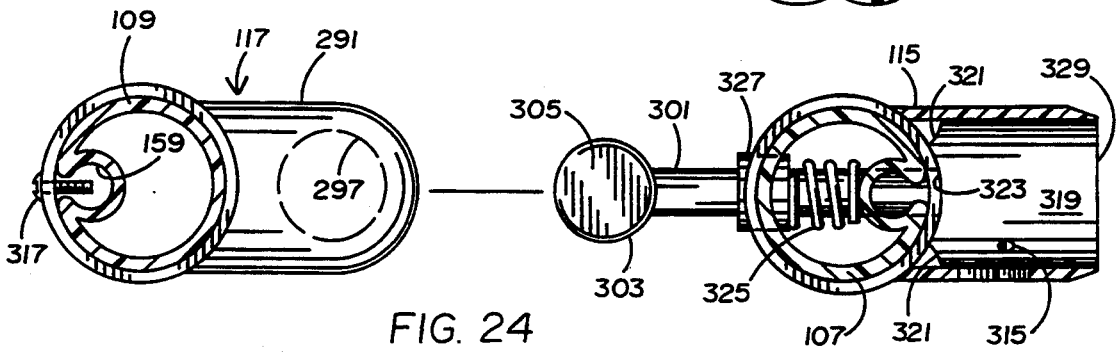
FIG. 24 is a side view of the two adjacent sections of fencing and their associated male and female duckbill connectors as shown in FIG. 22, having been moved into position to be locked together.
Figure 23:
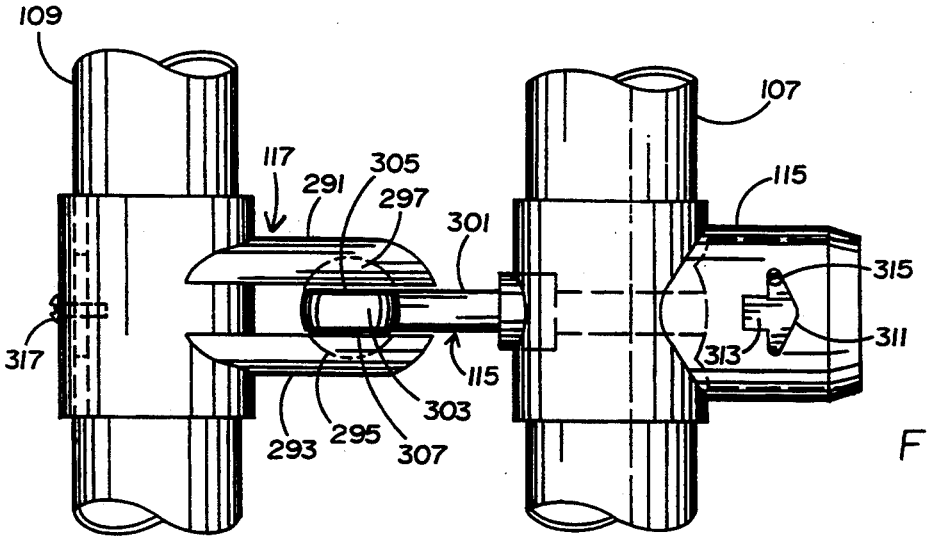
FIG. 23 is a top sectional view of the two adjacent sections of fencing and their associated male and female duckbill connectors shown in FIG. 22.

Referring to FIGS. 22–24, a detailed view of the male and female duckbill connectors 115 and 117 is shown. The female duckbill connector 117 has an upper lip 291 and a lower lip 293 both of which have a width of separation and both of which have a spherical depression, the spherical depression 295 which is visible in lower lip 293 in FIG. 22. In FIG. 23, the upper spherical depression 297 is shown in dashed line format in the upper lip 297.

Male duckbill connector 115 includes a rotatable shaft 301 having a spherical head 303 having a flattened upper section 305 and a flattened lower section 307. The flattened upper and lower sections 305 and 307 are parallel planar and have a distance of separation slightly greater than the distance of separation between the upper and lower lips 291 and 293, in order to form a loose snap fit. In this configuration, there will be some resistance, as to wind resistance, etc., and this configuration, when the shaft 301 is rotated to place the flattened upper and lower sections 305 and 307 in a horizontal attitude, the head 303 of the male duckbill connector 115 is admitted between the upper and lower lips 291 and 293 of the female duckbill connector 117.

When the spherical head 303 is positioned within the upper and lower spherical depressions 297 and 295, the shaft 301 and the spherical head 303 may be rotated to place the spherical portions of the spherical head 303 within the upper and lower spherical depressions 297 and 295 to form a "locked" position. Once this is accomplished, the spherical head 303 of the male duckbill connector 115 is locked between the upper and lower lips 291 and 293 of the female duckbill connector 117, although the connection is still enabled to pivot in order to place one fence section 101 at an angle with respect to an adjacent fence section 101. Typically, the locked position is utilized in conjunction with the crowd control position while the unlocked position is used when the fence 101 is used for sports play.

The mechanism controlling the rotation of the shaft 301 is of some interest, depending upon the amount of access desired for others to have in operating the fence 101 of the present invention. In the configuration of FIGS. 22–24, the higher amount of security is achieved, since the surface which may be engaged to turn the shaft 301 is somewhat inaccessible. Referring to the side of the male duckbill connector 115 opposite the shaft 301, an arrow shaped opening 311 reveals a small exposed surface 313 defining a small bore 315. The bore 315 is engageable with an object such as a screwdriver or large nail (not shown) to facilitates the rotation of the shaft 301.

Referring to FIG. 24, a top sectional view of the male and female duckbill connectors 115 and 117 are shown. Beginning with the female duckbill connector 117, we can see a screw 317 which enters the main body of the female duckbill connector 117 and bears against the surface 159 of the round structure 155 in order to fix the position of the female duckbill connector 117 with respect to the vertical side rail 109. This feature is especially important where two fence sections 101 which sit on uneven ground or other surface sought to be joined. In such a case, the axial position of the female duckbill connector 117 along the vertical side rail 109 can be relaxed sufficient to let the enlarged portions 151 of adjacent foot elements 141 and 143 and the T-shaped members 131 and 137 to all touch the ground as solidly as possible.

Inside the body of the male duckbill connector 115, the surface 313 is part of a cam head 319. The cam head 319 has two pairs of cam surfaces, namely a first pair of oppositely configured surfaces 321, and a second pair of oppositely configured surfaces 323. In FIG. 24, the surfaces 321 are un-engaged with the outer surface 151 of vertical side rail 107, while the surfaces 323 (one of which has an edge visible in FIG. 24) are engaged with the outer surface 151 of vertical side rail 107.

Inside the vertical side rail 107 is a spring 325 which engages the outer surface 157 of round structure 155 of vertical side rail 107 at one end, while engaging a raised land 327 on the shaft 301 at the springs other end. The shaft is urged axially in the direction of the head 303, and therefore urges the cam surfaces 321 and 323 against the round outer surface 151 of vertical side rail 107.

Thus, the cam head 319 and shaft 301, in order to turn, must cam between the contact of either the cam surface 321 or the cam surface 323 with outer surface 151 of vertical side rail 107. As this cam action occurs the shaft 301 is momentarily axially urged toward the cam head 319 and back again. In the configuration of FIGS. 22–24, a spectator would not be readily able to operate the shaft 301 to lock and unlock adjacent sections of the fence sections 101. The cam head 319 has a flat surface 329, and sides which are significantly covered by the outside housing of the male duckbill connector 115 which further reduces the accessibility of the cam head 319 to being turned by unauthorized persons. Someone not having a nail or other rigid structure to insert into bore 315 would be practically unable to operate the male duckbill connector, particularly against the relative strong force of the spring 325.

Figure 25:
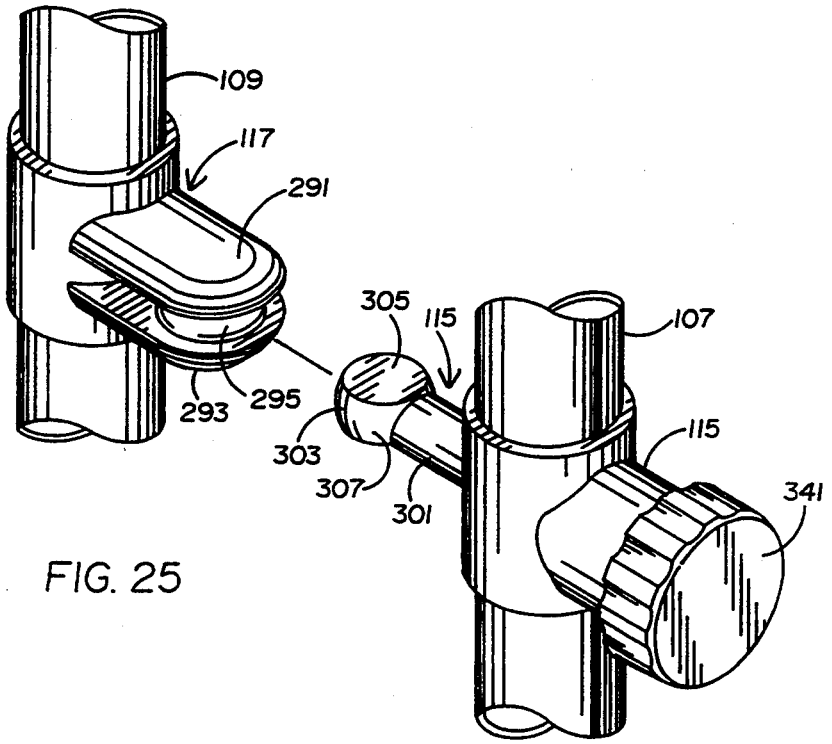
FIG. 25 is a perspective view of two adjacent sections of fencing and their associated male and female duckbill connectors which are easily operated by anyone, in position to achieve interconnection.
Figure 27:
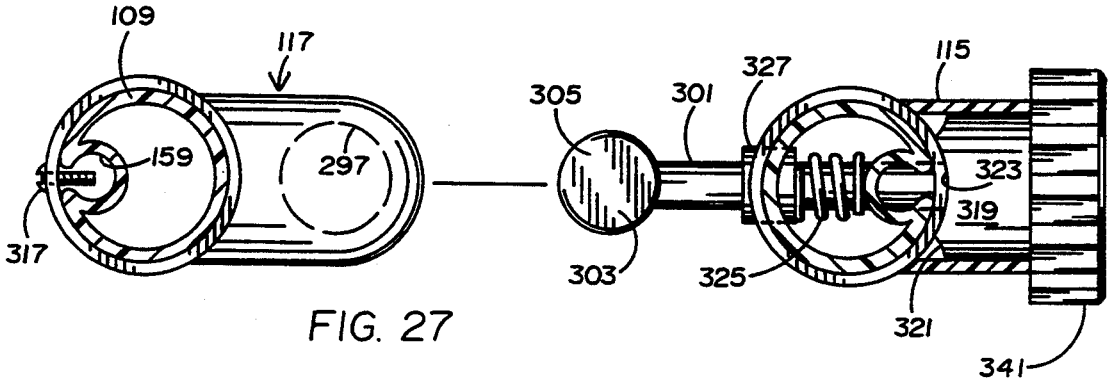
FIG. 27 is a side view of the two adjacent sections of fencing and their associated male and female duckbill connectors as shown in FIG. 25, having been moved into position to be locked together.
Figure 26:
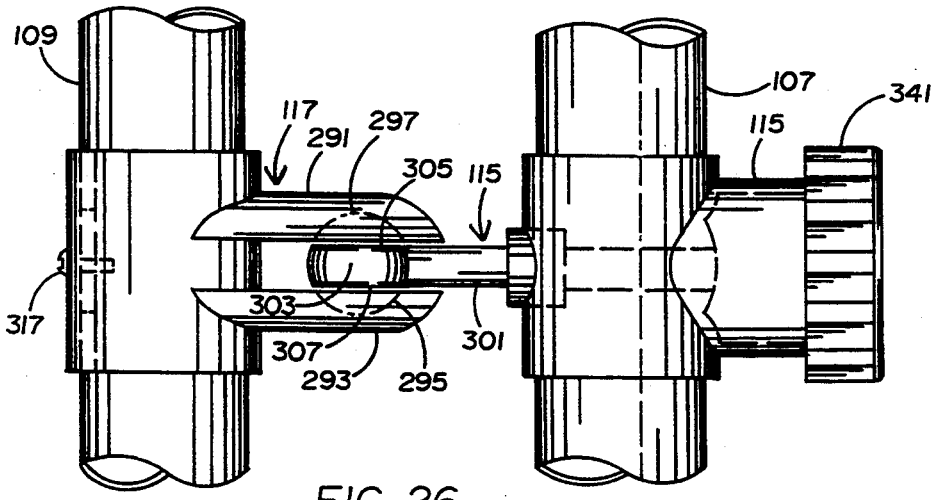
FIG. 26 is a top sectional view of the two adjacent sections of fencing and their associated male and female duckbill connectors shown in FIG. 25.

Referring to FIGS. 25–27, a series of views similar to those shown in FIGS. 22–24 illustrate the use of an external knob 341 to facilitate manual release and locking by anyone. The arrow shaped opening 311 and the aperture 315 is not needed and is not present. The details of the female duckbill connector 117 remain the Same.

Figure 28:
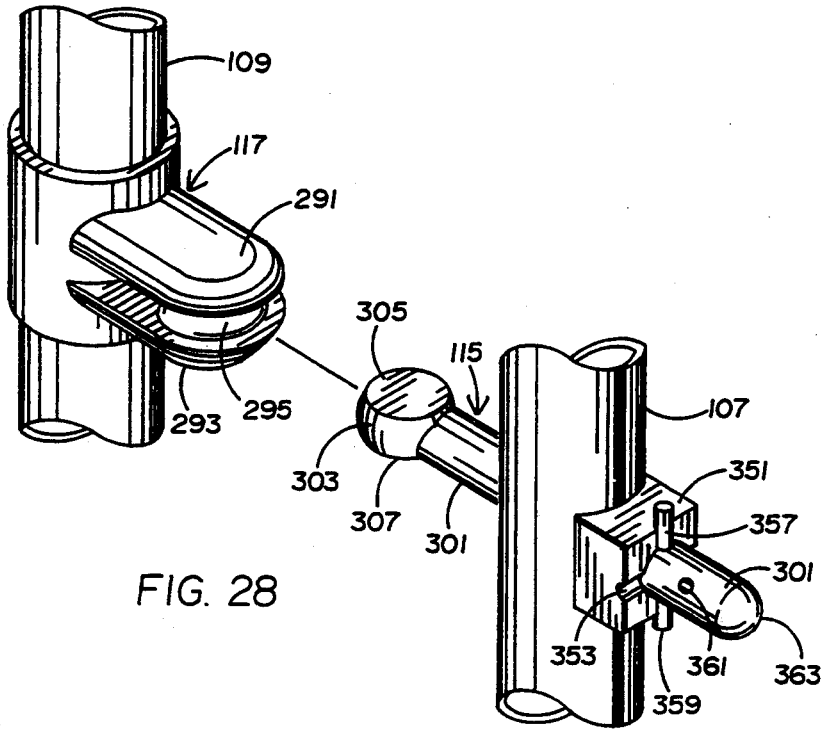
FIG. 28 is a perspective view of two adjacent sections of fencing and their associated male and female duckbill connectors which are tamper resistant, in position to achieve interconnection.
Figure 30:
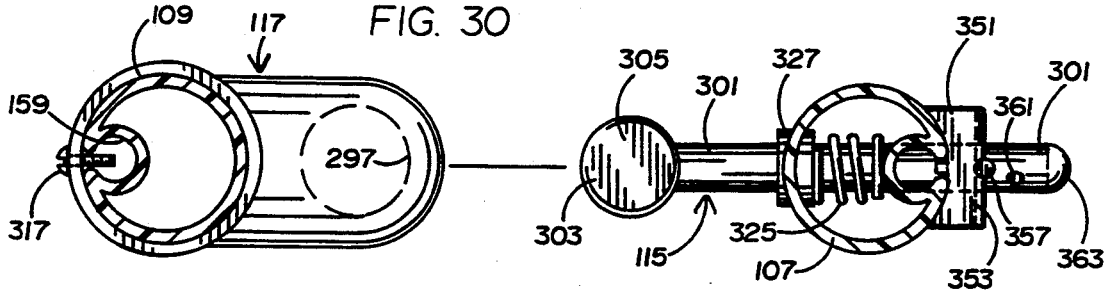
FIG. 30 is a side view of the two adjacent sections of fencing and their associated male and female duckbill connectors as shown in FIG. 28, having been moved into position to be locked together.
Figure 29:
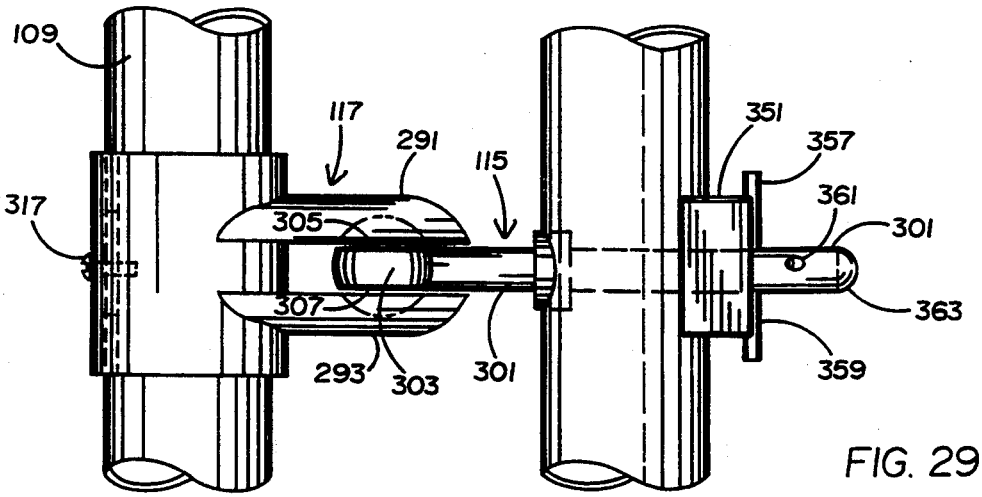
FIG. 29 is a top sectional view of the two adjacent sections of fencing and their associated male and female duckbill connectors shown in FIG. 28.

Referring to FIGS. 28–30, a series of views similar to those shown in FIGS. 22–24 illustrate the use of an external cam structure to facilitate somewhat controlled access to the locking and unlocking of the fence section 101. In this configuration, the details of the female duckbill connector 117 again remain the same.

The male duckbill connector 115 includes a cam block 351 having a first opposing set of notches 353 (one of which is shown in FIG. 28) and a second set of notches 355 (covered by cam pin structures to be discussed). The shaft 301 extends through the central portion of cam block 351 and supports a pair of oppositely disposed campins 357 and 359 which are shown as fitting within second set of notches 355.

Shaft 301 has an aperture 361 for engagement with a nail or other sturdy object to facilitate turning of the shaft 301. The end of the portion of the shaft 301 supporting the cam pins 357 and 359 has a rounded head 363.

In operation, the fence sections 101 of the second embodiment are joined together using the male and female duckbill connectors 115 and 117 which are snapped together in the loose, or unlocked configuration, while the foot elements 141 and 143 are positioned in the break away, or player contact position. In this configuration, when a player strikes one or two of the fence sections 101, two actions occur. First the male and female duckbill connectors 115 and 117 immediately release such that only the immediately contacted fence section 101 will be affected. Secondly, the foot elements 141 and 143 will begin to break away as previously described, and the fence section 101 falls flat.

The player or grounds keeper, after impact only needs to raise the center broken away section back to the vertical position to cause the fence section 101 which was broken away to snap back into place, and only a few additional moments are required to snap the re-uprighted fence section 101 into alignment with its adjacent fence sections 101 by use of the male and female duckbill connectors 115 and 117.

To achieve crowd control configuration, the foot elements 141 and 143 are adjusted to place the fence section 101 in crowd control configuration which disables the break away potential of the foot elements 141 and 143. Once the duckbill connectors 115 and 117 of adjacent fence sections 101 are attached, they are adjusted to the locked position by rotation of the spherical head 303 on shaft 301. When the fence sections 101 are locked together, each fence section 101 combines its own resistance to tilting with the resistance to tilting of its adjacent fence sections 101, to form a stronger crowd control fence. This is especially when the fence sections 101 are in an other than a linear alignment. Note that the duckbill connectors 115 and 117 are ideally suited for pivoting about the spherical depressions 295 and 297 of the female duckbill connector member 117 by the spherical portion 303 of the male duckbill connector. This can be done to form a corner at the intersection of two sections 101 having an angle ranging from a very acute angle to a straight, parallel relationship.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

I claim:

1. A portable fence comprising:

a frame, a panel of netting, means supporting the netting within the frame, the frame defining a section of fence, the frame including at least one upright member for supporting the frame in a generally vertical orientation relative to a field, a foot member, means attaching the foot member to the upright member in a generally orthogonal orientation so that the foot member may rest on the field and assist in holding the frame in a vertical orientation, the attachment means releasing the foot member from its orthogonal relationship to the upright member on applications of a predetermined force to the fence to permit the fence to collapse to the field, the attachment means reconnecting the foot member to the upright member in an orthogonal relationship when the frame is returned to its generally vertical orientation relative to the field; and wherein the frame is defined by peripheral tubular members, the peripheral tubular members each including a longitudinal slot for receiving a margin of the netting panel, said supporting means including a plurality of wedge elements for being received-within the marginal spaces of the net and the longitudinal slot of a tubular member to interlock the netting with the tubular members.

2. A portable fence as set forth in claim 1 in which the frame includes at least two upright members, said foot member for each of said upright members, said attachment ends means connecting each of said foot members to a corresponding upright member, said attachment means permitting the connected foot member to pivot relative to the plane of the frame to be movable between a position in which the major axis of the foot member is generally parallel to the frame and a position in which said major axis is generally perpendicular to the frame.

3. A portable fence comprising:

a frame, a panel of netting, means supporting the netting within the frame, the frame defining a section of fence, the frame including at least one upright member for supporting the frame in a generally vertical orientation relative to a field, a foot member, means attaching the foot member to the upright member in a generally orthogonal orientation so that the foot member may rest on the field and assist in holding the frame in a vertical orientation, the attachment means releasing the foot member from its orthogonal relationship to the upright member on applications of a predetermined force to the fence to permit the fence to collapse to the field, the attachment means reconnecting the foot member to the upright member in an orthogonal relationship when the frame is returned to its generally vertical orientation relative to the field; and wherein said attachment means connecting said foot member to said corresponding upright member includes a plug element attached to one of the members and snugly interfitting with the end section of the attached member, and extendable means holding the plug to said attached member but permitting the plug and end section to separate on application of said predetermined force to the fence to permit the foot member to pivot relative to the frame.

4. A portable fence comprising:

a frame, a panel of netting, means supporting the netting within the frame, the frame defining a section of fence, the frame including at least one upright member for supporting the frame in a generally vertical orientation relative to a field, a foot member, means attaching the foot member to the upright member in a generally orthogonal orientation so that the foot member may rest on the field and assist in holding the frame in a vertical orientation, the attachment means releasing the foot member from its orthogonal relationship to the upright member on applications of a predetermined force to the fence to permit the fence to collapse to the field, the attachment means reconnecting the foot member to the upright member in an orthogonal relationship when the frame is returned to its generally vertical orientation relative to the field; and means to releasably connect the fence to an adjacent section of fence, thereby permitting sections of the fence to be assembled into an extended fence.

5. A portable fence as set forth in claim 4 in which said releasable connection means includes a socket in the frame and a compressible plug member having two ends, one end of said compressible plug member of which is received in the socket under compression, whereby opposed ends of the plug member can connect adjacent sections of the fence by being compressed and received in opposed sockets in said adjacent sections.

6. A Collapsible portable fence section comprising:

a peripheral member defining a portion of the fence section, a base member engaged with said peripheral member of said fence section for supporting said fence in a vertical position on a field;

collapsible means connecting/said peripheral member with said base member of said fence section for permitting said fence section to collapse from said vertical position to a horizontal position lying flat on said field when a predetermined force is applied to said fence;

means received within said peripheral member for mechanically repositioning said fence section into said vertical position whenever said fence section has been collapsed to said horizontal position a hollow tube attached to said peripheral member and having at least one outlet extending therefrom;

at least one base tube;

at least one base connector having a plurality of hollow base outlets, a first of said base outlets being positioned perpendicular to a second base outlet, said first base outlet receiving and connected to said base tube;

a base plug having a circumference that permits it to be snugly received into said hollow tube outlet and said second base outlet;

plug-fixing means for fixing said base plug to one of said outlets which receive it;

whereby said base tube can pivot to any angle in the plate perpendicular to said hollow tube when said base plug is inserted into said hollow tube outlet.

7. A collapsible fence section as defined in claim 6 wherein said collapsible means includes said base plug and allows said base plug to slide out of at least one of said outlets when said predetermined force is applied to said fence section.

8. A collapsible portable fence section comprising:

a peripheral member defining a portion of the fence section, a base member engaged with said peripheral member of said fence section for supporting said fence in a vertical position on a field;

collapsible means connecting said peripheral member with said base member of said fence section for permitting said fence section to collapse from said vertical position to a horizontal position lying flat on said field when a predetermined force is applied to said fence;

means received within said peripheral member for mechanically positioning said fence section into said vertical position whenever said fence section has been collapsed to said horizontal position;

a resilient elastic element;

means fixing one end of said element within said peripheral member while said element is stretched, whereby said elastic element urges said base member and peripheral member into engagement with one another.

9. A collapsible portable fence section comprising:

a peripheral member defining a portion of the fence section, a base member engaged with said peripheral member of said fence section for supporting said fence in a vertical position on a field;

collapsible means connecting said peripheral member with said base member of said fence section for permitting said fence section to collapse from said vertical position to a horizontal position lying flat on said field when a predetermined force is applied to said fence; and means received within said peripheral member for mechanically repositioning said fence section into said vertical position whenever said fence section has been collapsed to said horizontal position;

each said fence section further comprising:

a plurality of peripheral members to define a rectangular frame;

a rectangular net being substantially the same size as said rectangular frame and positioned within said rectangular frame;

net securing means securing said net within said frame and to said peripheral members whereby said net prevents objects from passing through said frame;

a plurality of wedges, each being attached to an edge point of said net;

flanges fixed to said peripheral members and extending inward within said frame and toward one another;

each of said flanges having an opening shaped for closely receiving said wedges and for permitting said wedges to slide along the length of said flange but for preventing said wedges and the attached net from being pulled from the frame in a direction generally perpendicular to said peripheral members.

10. A collapsible fence section as defined in claim 9 wherein each of said fence section further comprises at least one intermediate support attached to said frame and contacting said net whereby said net is supported and its movement restricted.

11. A portable fence section comprising:

a panel of netting;

frame means for supporting said panel of netting;

a foot means for supporting said frame means;

support means, connecting said foot means to said frame means, to enable adjustment of said foot means, said Support means, frame means and panel of netting forming a upright section;

collapse means attached to said foot member for carrying said upright section in an upright orthogonal orientation when said foot member rests on a horizontal surface and for releasing said upright section to permit said upright section to collapse to said horizontal surface upon application of a predetermined force to said upright section, and for said upright section to be again carried in a vertical position when said upright section is returned to its generally vertical orientation relative to the horizontal surface; and attachment means on said upright section to permit one portable fence section to be interconnected to another fence section.

12. The portable fence section as set forth in claim 11 in which said collapse means is carried within said foot member.

13. A portable fence section as set forth in claim 11 in which said fence section has a first end and a second end and wherein said attachment means further comprises:

a male duckbill connector attached to one end of said fence section; and a female duckbill connector attached to the other end of said fence section.

14. A portable fence section as set forth in claim 13 wherein said male duckbill member further comprises:

a housing supported by said frame means;

a cylindrical cam head having at least a first cam surface complimentary with said frame means in a first position and at least a second cam surface complimentary with said frame means in a second position, said cam head carried within said housing and exposing a limited portion of the cylindrical surface of said cam head, said cam head defining a bore in said limited portion of said cylindrical surface engagable with a lever to facilitate the turning of said cam head about its axis;

a shaft connected to and co-axial with said cam head at one end and having a partial spherical head at its other end, said spherical head including a pair of opposed parallel planar surfaces having a separation sufficient to permit engagement with said female duckbill connector, said shaft also defining a circular raised land; and a spring engaging said frame means and said land to urge said cam head into at least one of said first and said second positions.

15. A portable fence section as set forth in claim 13 wherein said male duckbill member further comprises:

a cam block supported by said frame means and defining at least two non parallel cam grooves;

a shaft having a first end and a second end said first end defining a partial spherical head, said spherical head including a pair of opposed parallel planar surfaces having a separation sufficient to permit engagement with said female duckbill connector, said shaft also defining a bore engagable with a lever to facilitate the turning of said shaft head about its axis circular raised land; and at least one cam pin carried by said shaft nearer its second end, and complimentary with said cam grooves.

16. A portable fence section as set forth in claim 13 wherein said male duckbill member further comprises:

a housing supported by said frame means;

a cylindrical cam head having at least a first cam surface complimentary with said frame means in a first position and at least a second cam surface complimentary with said frame means in a second position, said cam head carried within said housing and having an end surface;

a shaft connected to and co-axial with said-cam head at one end and having a partial spherical head at its other end, said spherical head including a pair of opposed parallel planar surfaces having a separation sufficient to permit engagement with said female duckbill connector, said shaft also defining a circular raised land;

a knob attached to said end surface of said cylindrical cam head for facilitating manual axial rotation of said cam head; and a spring engaging said frame means and said land to urge said cam head into at least one of said first and said second positions.

17. A portable fence section as set forth in claim 11 in which said foot means is adjustable with respect to said support means to disable the operation of said collapse means.

* * * * *